US007294054B2

(12) United States Patent
Schugar et al.

(10) Patent No.: US 7,294,054 B2
(45) Date of Patent: Nov. 13, 2007

(54) WAGERING METHOD, DEVICE, AND COMPUTER READABLE STORAGE MEDIUM, FOR WAGERING ON PIECES IN A PROGRESSION

(76) Inventors: David Schugar, 3471 Sundial Dr., Hernando, MS (US) 38632; Michael Shackleford, 9200 Sienna Vista Dr., Las Vegas, NV (US) 89117

( * ) Notice: Subject to any disclaimer, the term of this patent is extended or adjusted under 35 U.S.C. 154(b) by 8 days.

(21) Appl. No.: 10/410,448

(22) Filed: Apr. 10, 2003

(65) Prior Publication Data

US 2004/0204213 A1 Oct. 14, 2004

(51) Int. Cl.
*A63F 9/24* (2006.01)

(52) U.S. Cl. ..... 463/6

(58) Field of Classification Search ..... 463/6
See application file for complete search history.

(56) References Cited

U.S. PATENT DOCUMENTS

| | | | | |
|---|---|---|---|---|
| 171,707 | A | | 1/1876 | Walker |
| 1,797,742 | A | | 3/1931 | Ward |
| D151,562 | S | | 10/1948 | Southwell |
| 2,739,815 | A | | 3/1956 | Fay |
| 3,463,496 | A | * | 8/1969 | Weinstein et al. ..... 273/246 |
| 3,560,127 | A | | 2/1971 | Imperato |
| 3,690,666 | A | | 9/1972 | Seitz |
| D226,111 | S | | 1/1973 | Kahn |
| 3,729,193 | A | | 4/1973 | Labis |
| 3,761,091 | A | | 9/1973 | Zohn |
| 3,883,143 | A | | 5/1975 | Kelly |
| 3,963,243 | A | | 6/1976 | Contento |
| 4,042,245 | A | | 8/1977 | Zarour |
| 4,060,246 | A | | 11/1977 | Ward |
| 4,082,289 | A | | 4/1978 | Merritt |
| 4,199,147 | A | | 4/1980 | Stansberry |
| 4,288,077 | A | | 9/1981 | Rose |
| 4,373,723 | A | | 2/1983 | Brown et al. |
| 4,428,580 | A | | 1/1984 | Pasquine |
| 4,527,798 | A | | 7/1985 | Siekierski et al. |
| 4,844,462 | A | * | 7/1989 | Lubniewski ..... 463/6 |
| 4,887,819 | A | | 12/1989 | Walker |
| 4,917,386 | A | | 4/1990 | Tozer |
| 5,050,888 | A | | 9/1991 | Schultz et al. |
| 5,085,441 | A | | 2/1992 | Jova |
| 5,092,605 | A | | 3/1992 | Hoffman |
| 5,149,101 | A | * | 9/1992 | Mazza et al. ..... 273/246 |
| 5,161,160 | A | | 11/1992 | Yaguchi et al. |
| 5,186,460 | A | | 2/1993 | Fongeallaz et al. |
| 5,226,655 | A | | 7/1993 | Rickabaugh |
| 5,367,286 | A | | 11/1994 | Voillat |

(Continued)

OTHER PUBLICATIONS

Ford, The Quiet Man, Republic Pictures, 1952.*

*Primary Examiner*—Corbett Coburn
(74) *Attorney, Agent, or Firm*—Muskin & Cusick LLC

(57) ABSTRACT

A method, apparatus, and computer readable storage, for wagering on a game of chance which includes (a) offering, before a game of chance progression commences, an initial wager on any of a plurality of pieces to first complete the progression, an initial payout for the initial wager based on the pieces having equal chances of winning; and (b) offering, during the progression, a real time wager on any of a plurality of pieces to first complete the progression, a real time payout for the real time wager based on computed chances of a selected piece first completing the progression based on current positions of the plurality of pieces.

23 Claims, 12 Drawing Sheets

U.S. PATENT DOCUMENTS 5,383,669 A 1/1995 Vance
5,411,258 A 5/1995 Wilson et al.
5,564,701 A 10/1996 Dettor
5,607,159 A 3/1997 Bryson
5,696,481 A 12/1997 Pejas et al.
5,795,226 A 8/1998 Yi
5,823,872 A 10/1998 Prather et al.
5,839,726 A * 11/1998 Luise ..... 273/246
5,934,676 A 8/1999 Rubin
6,088,259 A 7/2000 Chi
6,089,871 A 7/2000 Jaffe
6,210,275 B1 4/2001 Olsen
6,336,633 B1 1/2002 Webb
6,464,225 B1 10/2002 Webb
6,520,502 B1 2/2003 Drouhard
6,520,855 B2 2/2003 DeMar et al.
6,527,270 B2 3/2003 Maksymec et al.
7,025,353 B2 * 4/2006 Lydick ..... 273/246
2002/0066998 A1 6/2002 Stern
2002/0145252 A1 10/2002 Michalek

* cited by examiner

904

WAGERING METHOD, DEVICE, AND COMPUTER READABLE STORAGE MEDIUM, FOR WAGERING ON PIECES IN A PROGRESSION

BACKGROUND OF THE INVENTION

1. Field of the Invention

The present invention is directed to a method, device, and computer readable storage medium for taking wagers from players. More particularly, the invention relates to wagering on a progression, such as a simulated horse race, both before and during the progression.

2. Description of the Related Art

Wagering methods and devices come in all forms. Many prior art methods have been devised for betting on both real and a simulated horserace. Such prior art methods have many limitations in their enjoyment and effectiveness as wagering devices.

One such limitation of prior art devices is that all bets must be placed prior to the race beginning, and once the race starts all bets are closed. Of course, this is logical because if a player could place a bet during a horserace, he would no doubt bet on the horse that was about to win. However, this limitation results in less excitement for the bettors, as once the race starts they are limited to passively watching the race. Other limitations of the prior art also discourage such games to be used in casino environments, in part due to there being no ideal way for the house to gain an advantage.

A casino horseracing game has been developed using mechanical horses, however this game has numerous disadvantages. As described above, this game can only allow wagers before the racing has begun.

Therefore, what is needed is a way where wagers can be placed during, and not only before, a horserace or any other type of challenge. What is also needed is a way for a casino or betting parlor to take such wagers while making the wagers more attractive to players who dislike the inconvenience of having to pay a house commission on every bet won.

SUMMARY OF THE INVENTION

It is an aspect of the present invention to provide improvements and innovations in wagering devices, methods, and computer readable storage media for controlling devices which implement such methods.

The above aspects can be obtained by a system that includes (a) offering, before a game of chance progression commences, an initial wager on any of a plurality of pieces to first complete the progression, an initial payout for the initial wager based on the pieces having equal chances of winning; and (b) offering, during the progression, a real time wager on any of a plurality of pieces to first complete the progression, a real time payout for the real time wager based on computed chances of a selected piece first completing the progression based on current positions of the plurality of pieces.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
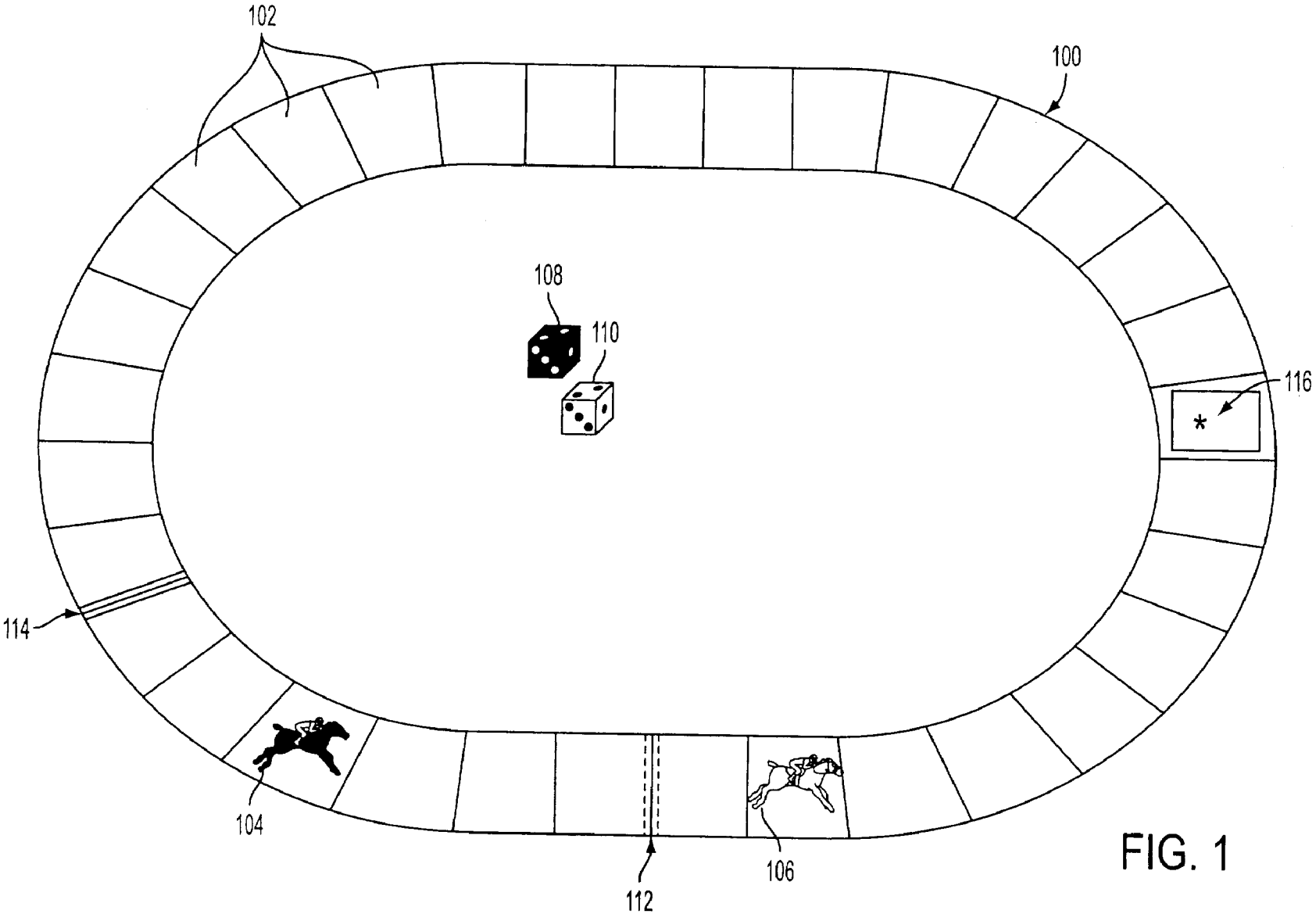
FIG. 1 is a block diagram illustrating an example of playing apparatus of the invention, according to an embodiment of the invention.

Reference will now be made in detail to the presently preferred embodiments of the invention, examples of which are illustrated in the accompanying drawings, wherein like reference numerals refer to like elements throughout.

The present invention relates to a wagering game that can be used by a casino for profit. The game involves a player betting on a progression. A progression can be defined as a game of chance whereby pieces are moved or manipulated to complete a goal. A player bets that a selected piece (or object) in which the player hopes his selected piece will finish a goal first before the other pieces. Examples of such game of chance progressions can comprise: horses racing around a track; artificial climbers climbing up a building or mountain; artificial firemen putting out a fire; and artificial men competing to eat their pile of hot dogs or pies. The invention is by no means limited to these progressions, but can be used with any type of progression imaginable. The progression is a game of chance progression because pieces move by chance, there is no human skill involved.

FIG. 1 is a block diagram illustrating an example of playing apparatus of the invention, according to an embodiment of the invention. A path (in this case a circular racetrack 100) is divided into 33 discrete slots 102. There are two horses (pieces), a black horse 104 and a white horse 106. The progression starts with the horses 104 106 in the slot right after a starting line 112, moves the horses around the racetrack, and the horse that passes the finish line 114 first wins. Each horse typically lies in one of the slots.

For ease of reference the slots can be numbered, for example the first slot after the finish line can be labeled at slot 1, the next slot can be labeled slot 2, the slot right before the finish line 114 can be labeled slot 27, and the slot right before the starting line 112 can be labeled slot 33. The numbering and game play can proceed clockwise or counterclockwise. Of course, any size field with any number of slots can be used.

Numerous advancing mechanisms can be used to advance the horses 104 106 in the progression. One possible mechanism is to assign a particular die to each piece. All the dice are rolled, and each piece is advanced according to the piece's respective roll.

Thus, in this example, we have a two dice, a black die 108 for the black horse 104 and a white die 110 for the white horse 106. Both horses 104, 106 start in slot 1 (the slot immediately to the right of the starting line 112). Both dice 108 110 are rolled, and each horse is moved ahead (counter clockwise in this example) a number of slots that the respective die rolls. For example, if the white die 108 rolls a 5 and the black die 110 rolls a 1, the white horse 104 is moved ahead 5 slots and the black horse 106 is moved ahead 1 slot.

This method of rolling the dice and moving the horses accordingly and is typically repeated until enough horses pass the finish line 114 (i.e. a horse lies in slot 28 or beyond) to decide all active bets. In some cases, horses may cross the finish line in the same roll of the dice. This would be known as a "photo finish." In this case, the horse which is further ahead would be considered the winner. Thus, in this example, slots 28-33 are past the finish line but used for the photo finish. In the event that two or more horses cross the finish line in the same turn wherein neither one of them is ahead of the other (they both lie in the same slot), this is considered a tie.

The playing field can also optionally include a "bonus slot" 116. If a particular piece lands on the bonus slot 116, a player who bet on the particular piece may be entitled to a special bonus. More on this embodiment will be discussed below.

Before the game begins, a player can choose to wager on either the white horse or the black horse. Of course, multiple players can simultaneously wager on horses of their choosing. When the game is over, the players who bet on the winning horse of course win their bets, and players who bet on the losing horse lose their bets.

A casino can choose a payout schedule in a manner they deem appropriate and profitable. According to one embodiment of the present invention, betting on a particular horse pays in direct proportion to the number of horses in the race. For example if there are two horses in the race, a bet on one horse pays 1:1 (even money) if that horse wins, and the player loses his entire wager if his horse loses. If there are three horses in the race, a bet on one horse can pay 2:1 if that horse wins. In the event of a tie, the house can take a fraction of the player's wager. The fraction could ideally be 12 (50%) of the original wager. It is in the handling of ties as described above that the house gains an overall monetary advantage over the player. Thus, in one embodiment of the invention, bets placed on a piece which wins will pays the player true odds, and the house does not take a commission on these bets. Players may find this system advantageous, as if their horse wins, they pay no commission to the house. It is noted that with the parameters selected as follows: 2 pieces, 27 slots (the $28^{th}$ slot wins), and a six sided die for each piece, the probability of each piece winning is 47.9% and the house advantage is 2.1% (assuming the house takes 50% of a tying wager).

Note that the above description uses dice as an advancing mechanism to advance the pieces, although any other advancing mechanism can be used to advance pieces as well. For example, a wheel could be spun with numbers on it; an electronic random number generator can generate such an advancing number for each piece, etc.

In one embodiment of the present invention, all of the progression parameters, including but not limited to, the number of pieces in the progression, the number of slots on the path, the range of the advancing mechanism (i.e. the number of sides on a die or wheel), and the location of the bonus square can be selected by the player before a progression begins. The selection can be made using any standard input/output devices and interfaces, as discussed below. Upon any change in the parameters, the odds and payout for each type of bet should be calculated for the particular parameters chosen. Any conventional mathematical method for calculating these odds and payouts can be used, as known in the art of probability or statistics, or the simulation method described below can be used. If the simulation method described below is used to calculate the payouts after a change in parameters is made, the parameters should be set to match the parameters selected so that the results of the simulation match the desired game.

Figure 2:
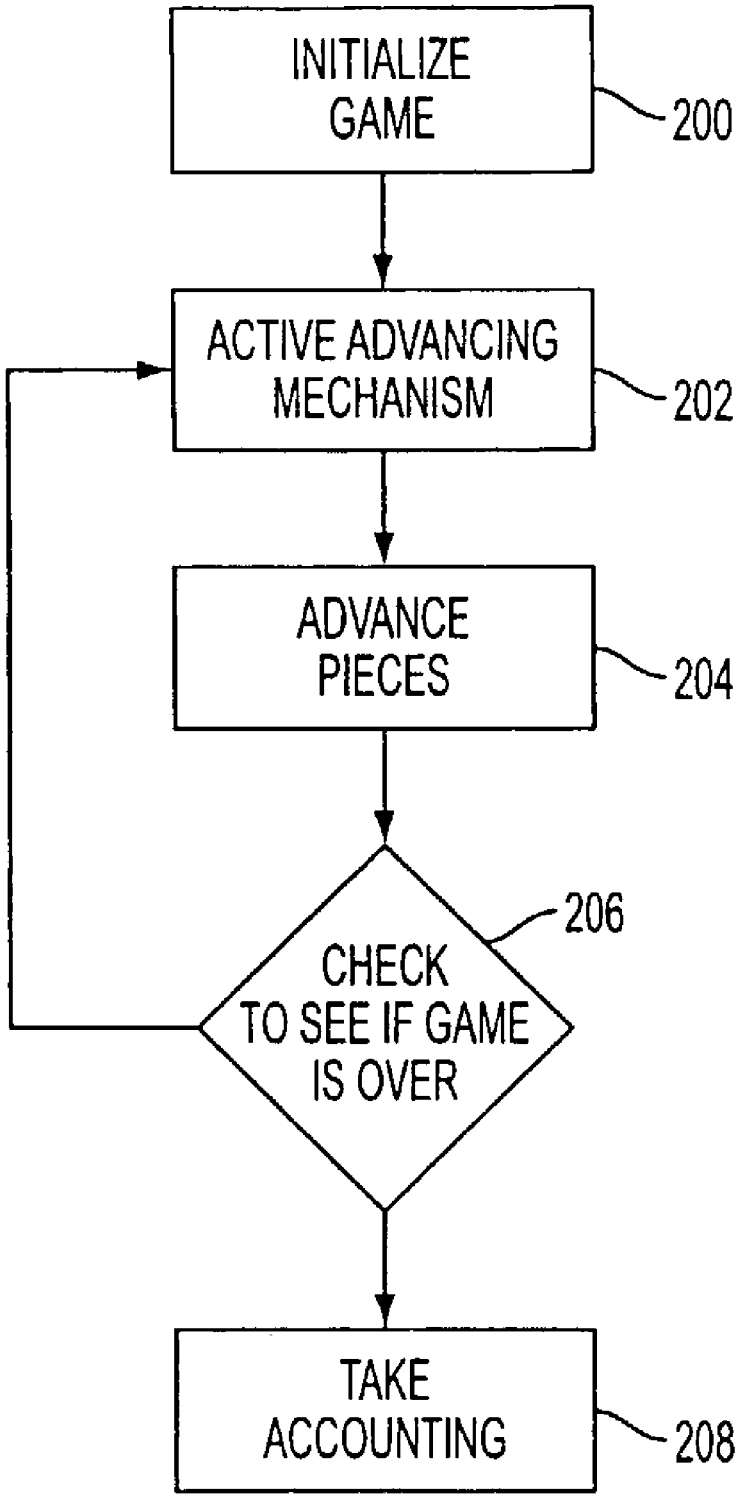
FIG. 2 is a flowchart illustrating a method of implementing a progression, according to an embodiment of the present invention.

FIG. 2 is a flowchart illustrating a method of implementing a progression, according to an embodiment of the present invention.

Initially, the progression starts at operation 200, which initializes the game, including resetting the pieces and taking bets. Initialization also includes the option of offering to the player the opportunity to customize the game, such as choosing the number of pieces, slots, range of the advancing mechanism, location of bonus square, etc.

From operation 200, the progression proceeds to operation 202, which activates an advancing mechanism to generate information used to advance the pieces.

From operation 202, the progression proceeds to operation 204, which advances the pieces according to information generated by the advancing mechanism.

From operation 204, the progression proceeds to operation 206, which checks to see if the game is over. Typically, once all of the horses have crossed the finish line that affect any live bets, the game is over. If continuing the progression does not affect any live bet, then there is no point in doing so, although continuing the progression can still optionally be done. If the game is not over yet, the progression returns to operation 202, wherein the advancing mechanism is activated again.

If the check in operation 206 determines that the game is over, then the progression proceeds to operation 208, which take accounting. Winners are paid according to the determined odds and losing wagers are taken.

It is noted that for simplicity, the above example only uses two horses. However, any number of horses can be used, and a racetrack with any number of slots can also be used. Also, a die with any number of sides can also be used. One preferred embodiment of the invention uses 2-3 horses for a table version (to be discussed later) or 4-5 or an electronic gaming device (to be discussed later), 27 slots, and six-sided dice.

Figure 3:
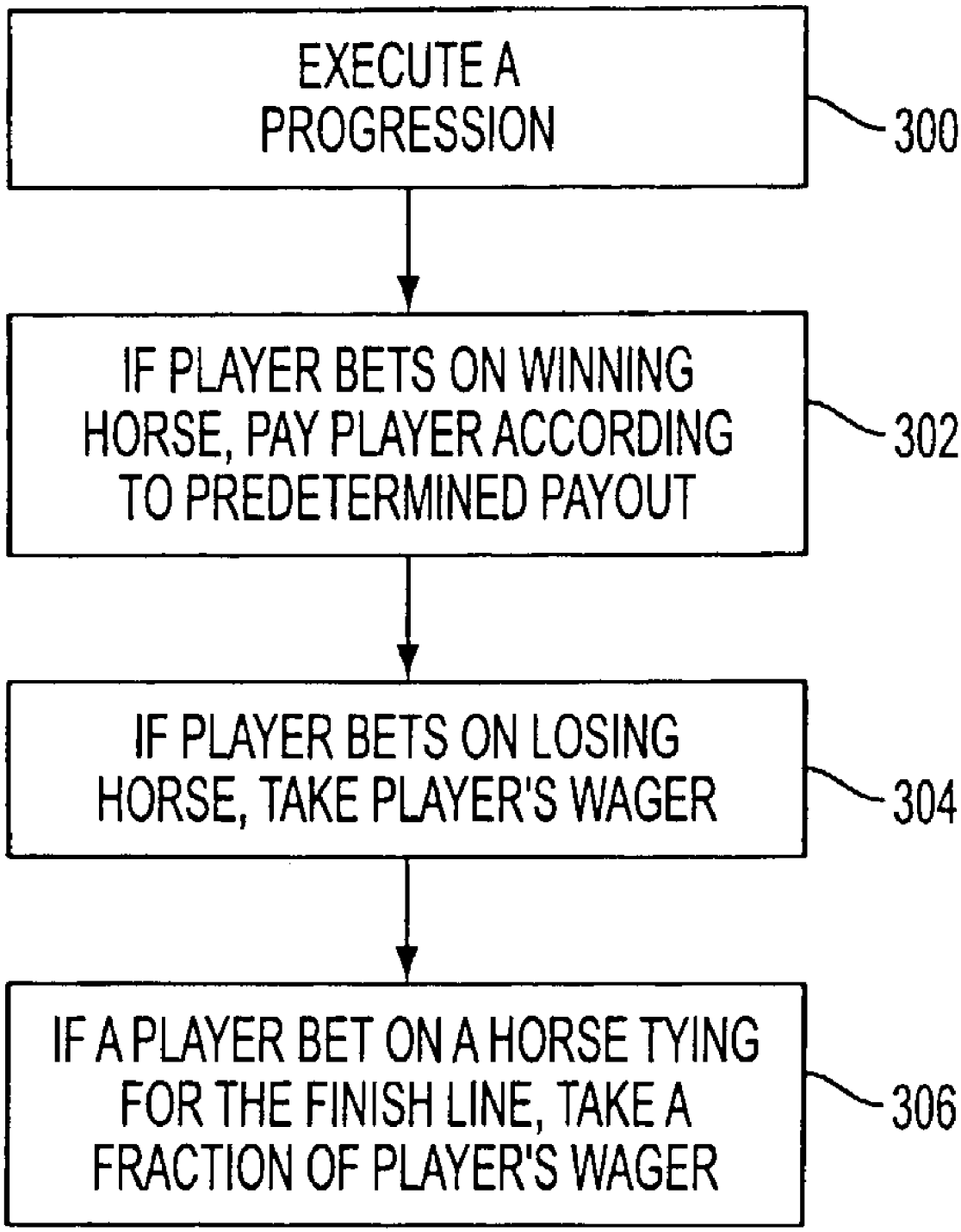
FIG. 3 is a flowchart illustrating a basic method of operation of the invention, according to an embodiment of the invention.

FIG. 3 is a flowchart illustrating a basic method of operation of the invention, according to an embodiment of the invention.

The method starts with operation 300, which executes a progression as described above.

From operation 300, the method proceeds to operation 302, wherein if a player bet on a winning horse, he is paid according to a predetermined payout.

Otherwise, the method proceeds to operation 304, wherein if a player bet on a losing horse, which takes player's wager.

Otherwise, the method proceeds to operation 306, wherein if a player bet on a horse tying for the finish line, where the player loses a fraction of his wager.

It is noted that in the above embodiment of the game, wagers are taken only before the progression begins.

To add excitement to the game, in another embodiment of the present invention, wagers can be made during the progression. For example, in the two horse example given above, the white horse might be at slot 15 and the black horse might be at slot 10. A player may wish to bet on the white horse since the white horse is in the lead. The payout for betting on the white horse would be computed (to be discussed more below) and would be lower than 1:1 since it is more likely that the white horse would win. Alternatively, a player may wish to bet on the underdog and hope that the black horse would win. The payout that the black horse would pay would be higher than 1:1 since the odds are less likely the black horse would win. In this way, a player can be offered additional excitement by betting on the race while it is in progress. Such betting on future events can be also be labeled a "futures bet" and a bet during the progression can be labeled as a "real time" bet.

Figure 4:
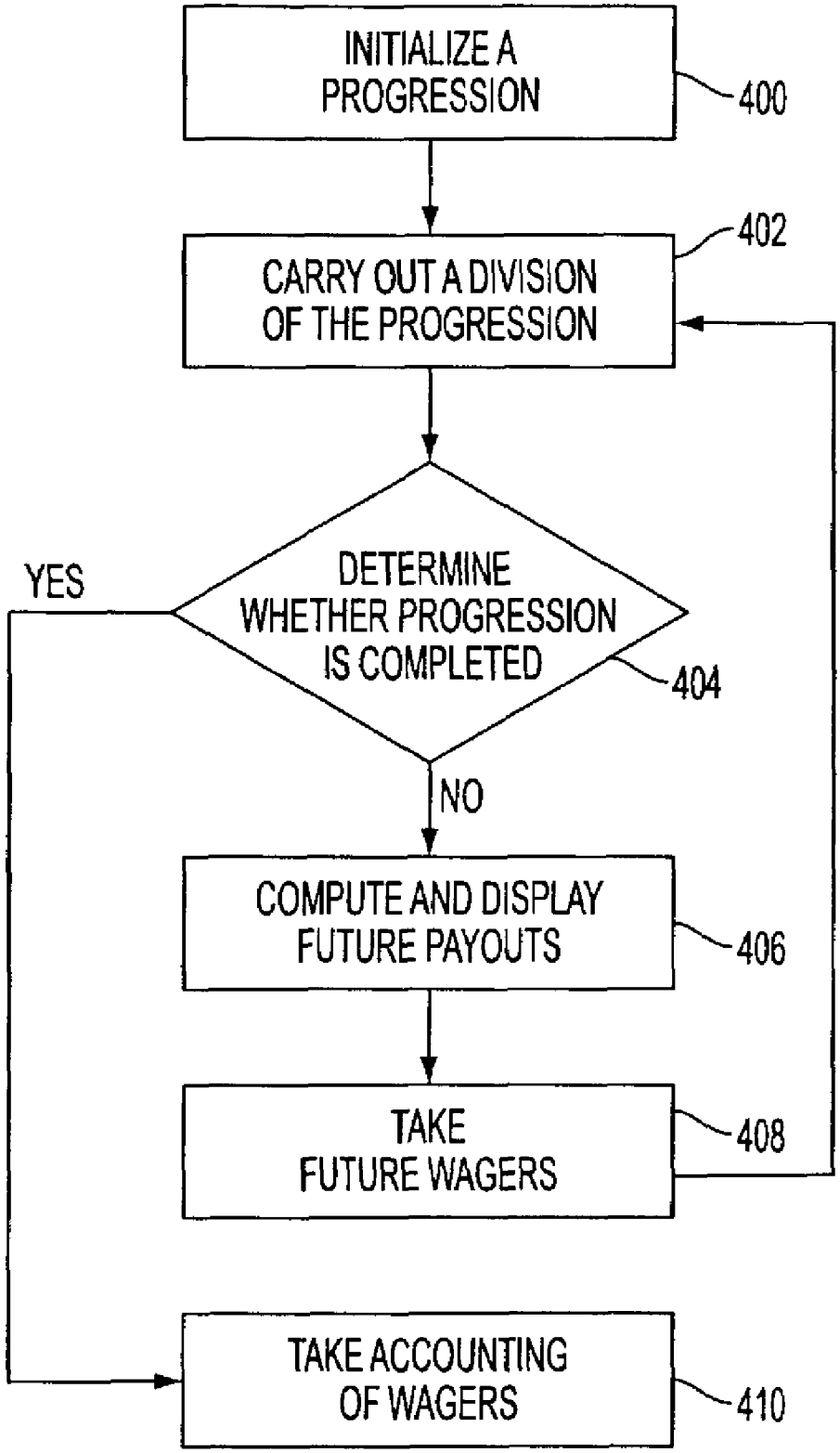
FIG. 4 is a flowchart illustrating a futures method of operation of the invention, according to an embodiment of the invention.

FIG. 4 is a flowchart illustrating a futures method of operation of the invention, according to an embodiment of the invention.

The method starts with operation 400, which initializes a progression. Such initialization may comprise resetting all the pieces to a starting point, and taking initial wagers.

From operation 400, the method proceeds to operation 402, which carries out a division of the progression, as described above.

From operation 402, the method proceeds to operation 404, which determines whether the progression is completed. If the progression is completed, the method proceeds to operation 410. If the progression is not completed, the method proceeds to operation 406.

In operation 406, the method computes and displays futures payouts based on fixed or variable house commission. More about computing futures payouts including an explanation of variable commission will be discussed below. Also, different types of futures bets in addition to the ones described above are also described below. Payouts respective to each of the pieces to finish the progression first are displayed.

From operation 406, the method proceeds to operation 408 which takes futures wagers. A player, after viewing the positions of the pieces and the futures payouts for each piece, can decide to make a bet on a selected piece which will pay the piece's respective payout. From operation 408, the method returns to operation 402.

If the determining operation 404 determines that the progression has been completed, then the method proceeds to operation 410 which takes accounting of the wagers. All bets, whether they were placed before the progression began, or were placed during the progression (a futures bet) are addressed. Losing bets are taken and winning bets are paid according to the bets' respective payout odds.

In an embodiment of the present invention, if a wager placed before the progression begins ultimately ties with another piece instead of winning the progression, the player loses only half of his original wager. Any other fraction other than half can also be used. In another embodiment of the present invention, if a wager placed after the progression has begun ties to win the progression, the player loses his entire original bet In another embodiment, a tie does not result in a monetary win or loss for the player (in this embodiment the house would gain their advantage by taking a commission on other bets). In an alternative embodiment of the present invention, if a wager placed after the progression has begun ties to win the progression, the player loses a fraction of his original wager. A casino can experiment using various combinations of these payouts on a tie to suit their needs.

In a further embodiment of the present invention, a player can place an affirmative bet on a tie. In other words, a player can make a wager that a particular piece will tie with any other piece. The payout for such a bet will be the true odds of such a tie occurring (which can be calculated using the methods described below) adjusted (calculated using methods described below) for an optional house commission.

The futures (or real time) odds are calculated after each division of the progression and are displayed. The futures odds that are calculated should of course reflect the odds of each piece winning based on the positions of all of the pieces. Of course, pieces in the lead will have a lower payout than pieces that are losing.

The futures odds can be calculated by a computer simulation. A digital computer can take a "snapshot" of the current positions of all of the pieces, and iteratively run a very large number of progressions. The simulation also accounts for the number of slots in the progression, the number of pieces used, and the characteristics of the advancing mechanism (i.e. how many sides are on a die used, etc.) The results from the iterations are tabulated, and odds for each piece winning the race are computed.

The iterative simulation can either be a random simulation or a recursive simulation. A random simulation uses a simulated advancing mechanism which uses random numbers. A recursive simulation also uses a simulated advancing mechanism, but instead of using random numbers, all possible permutations of the advancing mechanism are looped through. Generally, the recursive simulation is preferred as it will be more accurate, although it will take a longer time. A full recursive simulation should produce results which are "exactly right." Thus if the preferred recursive simulation takes too long of a time to calculate odds (the time will of course depend on the platform used, variables, etc.) then the random simulation can be used. Appendix A herein includes code which implements both a random and a recursive simulation, and is compiled by Visual Studio®. The code herein is written for two pieces, 27 slots, and a 6 sided die, although these parameters can be easily changed by adjusting the corresponding variables in the code. Of course, other programming languages and compilers can be used, and the code is meant to be illustrative of one approach of determining the futures. The futures can be computed in real time after each division of the progression, or alternatively a table can be pre-computed and used as a look up table. The simulation method can be used to calculate the odds for any type of bet mentioned herein.

It is noted that the above described method works well for a pure game of chance, i.e. one that involves no human skill. This is because the odds can be accurately determined by a computer simulation. This is also in contrast to some sports books which use a "pari-mutuel" supply and demand system to determine odds, or alternatively use human odds makers. The human element adds inaccuracy to the system.

Figure 5:
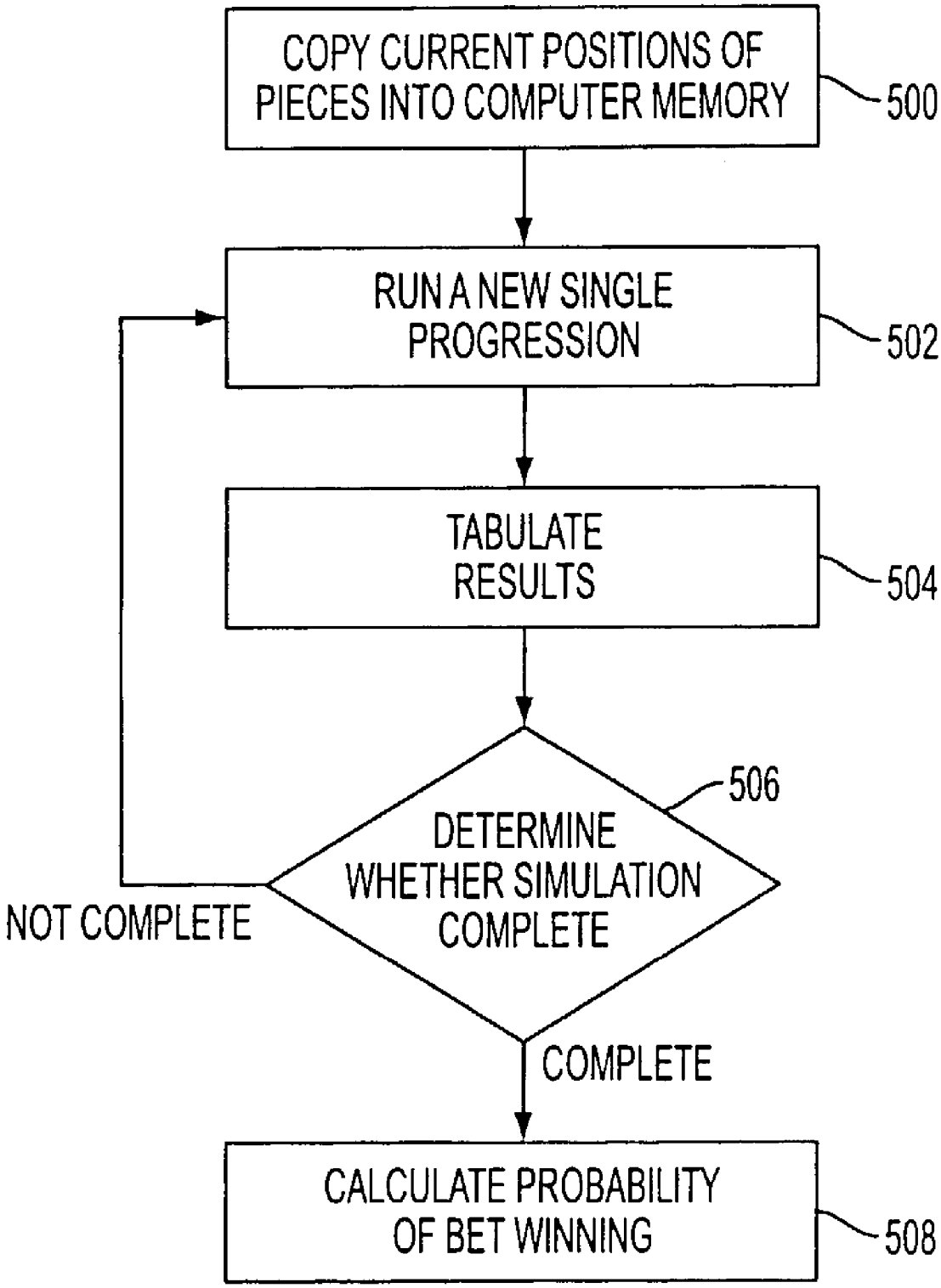
FIG. 5 is a flowchart illustrating a method of calculating futures odds, according to an embodiment of the present invention.

FIG. 5 is a flowchart illustrating a method of calculating futures odds, according to an embodiment of the present invention. This method is used by the code in the Appendix A, and is described herein in a more simplified manner.

The method starts with operation 500, which copies current positions of the pieces into a computer's memory.

The method then proceeds to operation 502, which runs a new single progression simulation through completion, as described above.

From operation 502, the method proceeds to operation 504, in which tabulates results in computer memory. For example, each horse can have a counter and this counter is incremented when this horse wins. The tabulation can also be more complex and store the position that every horse finishes in.

From operation 504, the method proceeds to operation 506 which determines whether the simulation is completed. When using the recursive simulation, the simulation is typically completed when all possible permutations have been cycled through. When using the random simulation, the simulation can be completed after a predetermined period of time passes. Alternatively, odds for one or more horses winning can be sampled, and when the variation of the chances for this horse winning (calculated as described below) falls below a certain predetermined threshold, it can be concluded that a desired level of accuracy has been reached and the simulation can terminate. If the simulation is not complete, the method returns to operation 502. If the simulation is complete, the method proceeds to operation 508.

In operation 508, the method calculates the probability of the bet winning. This probability of a particular bet winning (such as betting on a particular horse) a progression after the progression has commenced is=# of tabulated wins for the particular horse/total number of simulated progressions.

Thus, using the method as illustrated in FIG. 5, real time odds can be computed and displayed to players after a progression has already started.

The following Tables I, II and III show the probability of white winning at each possible set of positions between turns. The following tables were calculated by using both a random simulation as well as a recursive simulation (the results were the same). These tables are presented herein to illustrate how the computed odds can be used to determine payouts. White's total is along the left column and black's total along the top row. Table I represents black positions from 1 to 9, table 2 10 to 18, and table 3 19 to 27.

TABLE I

White 1 to 27, Black 1 to 9

| | Black | | | | | | | | |
|---|---|---|---|---|---|---|---|---|---|
| White | 1 | 2 | 3 | 4 | 5 | 6 | 7 | 8 | 9 |
| 1 | 0.478573 | 0.419435 | 0.361005 | 0.304610 | 0.251513 | 0.202816 | 0.000000 | 0.000000 | 0.000000 |
| 2 | 0.537792 | 0.478166 | 0.417913 | 0.358411 | 0.301065 | 0.247208 | 0.197993 | 0.154317 | 0.116748 |
| 3 | 0.597276 | 0.538504 | 0.477735 | 0.416302 | 0.355667 | 0.297321 | 0.242670 | 0.192929 | 0.149030 |
| 4 | 0.655682 | 0.599124 | 0.539260 | 0.477278 | 0.414594 | 0.352762 | 0.293360 | 0.237881 | 0.187610 |
| 5 | 0.711661 | 0.658601 | 0.601082 | 0.540060 | 0.476792 | 0.412781 | 0.349676 | 0.289159 | 0.232822 |
| 6 | 0.763959 | 0.715506 | 0.661689 | 0.603156 | 0.540907 | 0.476274 | 0.410847 | 0.346386 | 0.284692 |
| 7 | 0.000000 | 0.768518 | 0.719569 | 0.664960 | 0.605358 | 0.541809 | 0.475717 | 0.408774 | 0.342859 |
| 8 | 0.000000 | 0.816518 | 0.773322 | 0.723866 | 0.668434 | 0.607707 | 0.542777 | 0.475119 | 0.406530 |
| 9 | 0.000000 | 0.858675 | 0.821771 | 0.778387 | 0.728423 | 0.672145 | 0.610243 | 0.543840 | 0.474471 |
| 10 | 0.000000 | 0.894514 | 0.864061 | 0.827281 | 0.783732 | 0.733268 | 0.676127 | 0.612987 | 0.544979 |
| 11 | 0.000000 | 0.923939 | 0.899730 | 0.869675 | 0.833062 | 0.789383 | 0.738435 | 0.680406 | 0.615926 |
| 12 | 0.000000 | 0.947207 | 0.928727 | 0.905127 | 0.875525 | 0.839136 | 0.795376 | 0.743963 | 0.684996 |
| 13 | 0.000000 | 0.000000 | 0.951375 | 0.933633 | 0.910698 | 0.881617 | 0.845529 | 0.801759 | 0.749912 |
| 14 | 0.000000 | 0.000000 | 0.968308 | 0.955591 | 0.938632 | 0.916428 | 0.887962 | 0.852295 | 0.808645 |
| 15 | 0.000000 | 0.000000 | 0.980377 | 0.971727 | 0.959809 | 0.943676 | 0.922289 | 0.894593 | 0.859583 |
| 16 | 0.000000 | 0.000000 | 0.988541 | 0.982992 | 0.975079 | 0.963981 | 0.948746 | 0.928334 | 0.901676 |
| 17 | 0.000000 | 0.000000 | 0.993748 | 0.990420 | 0.985494 | 0.978319 | 0.968096 | 0.953907 | 0.934752 |
| 18 | 0.000000 | 0.000000 | 0.996851 | 0.995005 | 0.992160 | 0.987840 | 0.981437 | 0.972218 | 0.959345 |
| 19 | 0.000000 | 0.000000 | 0.000000 | 0.997626 | 0.996119 | 0.993726 | 0.990025 | 0.984490 | 0.976499 |
| 20 | 0.000000 | 0.000000 | 0.000000 | 0.998994 | 0.998274 | 0.997070 | 0.995123 | 0.992095 | 0.987578 |
| 21 | 0.000000 | 0.000000 | 0.000000 | 0.999638 | 0.999337 | 0.998801 | 0.997885 | 0.996396 | 0.994091 |
| 22 | 0.000000 | 0.000000 | 0.000000 | 0.999899 | 0.999796 | 0.999596 | 0.999229 | 0.998601 | 0.997585 |
| 23 | 0.000000 | 0.000000 | 0.000000 | 0.999983 | 0.999958 | 0.999901 | 0.999788 | 0.999580 | 0.999228 |
| 24 | 0.000000 | 0.000000 | 0.000000 | 1.000000 | 0.999997 | 0.999988 | 0.999967 | 0.999925 | 0.999850 |
| 25 | 0.000000 | 0.000000 | 0.000000 | 0.000000 | 1.000000 | 1.000000 | 1.000000 | 1.000000 | 1.000000 |
| 26 | 0.000000 | 0.000000 | 0.000000 | 0.000000 | 1.000000 | 1.000000 | 1.000000 | 1.000000 | 1.000000 |
| 27 | 0.000000 | 0.000000 | 0.000000 | 0.000000 | 1.000000 | 1.000000 | 1.000000 | 1.000000 | 1.000000 |

TABLE II

White 1 to 27, Black 10 to 18

| | Black | | | | | | | | |
|---|---|---|---|---|---|---|---|---|---|
| White | 10 | 11 | 12 | 13 | 14 | 15 | 16 | 17 | 18 |
| 1 | 0.000000 | 0.000000 | 0.000000 | 0.000000 | 0.000000 | 0.000000 | 0.000000 | 0.000000 | 0.000000 |
| 2 | 0.085493 | 0.060403 | 0.041024 | 0.000000 | 0.000000 | 0.000000 | 0.000000 | 0.000000 | 0.000000 |
| 3 | 0.111539 | 0.080628 | 0.056089 | 0.037395 | 0.023779 | 0.014336 | 0.008132 | 0.004297 | 0.002089 |
| 4 | 0.143511 | 0.106142 | 0.075634 | 0.051713 | 0.033769 | 0.020941 | 0.012242 | 0.006683 | 0.003365 |
| 5 | 0.182024 | 0.137755 | 0.100562 | 0.070527 | 0.047302 | 0.030178 | 0.018186 | 0.010258 | 0.005354 |
| 6 | 0.227473 | 0.176156 | 0.131754 | 0.094799 | 0.065322 | 0.042889 | 0.026655 | 0.015546 | 0.008416 |
| 7 | 0.279930 | 0.221803 | 0.169973 | 0.125481 | 0.088845 | 0.060042 | 0.038491 | 0.023218 | 0.013042 |
| 8 | 0.339067 | 0.274834 | 0.215760 | 0.163415 | 0.118883 | 0.082684 | 0.054662 | 0.034086 | 0.019853 |
| 9 | 0.404107 | 0.334978 | 0.269339 | 0.209242 | 0.156363 | 0.111871 | 0.076215 | 0.049081 | 0.029593 |
| 10 | 0.473770 | 0.401513 | 0.330610 | 0.263470 | 0.202301 | 0.148932 | 0.104594 | 0.069585 | 0.043446 |
| 11 | 0.546180 | 0.473013 | 0.398745 | 0.325945 | 0.257199 | 0.194910 | 0.141180 | 0.097108 | 0.062860 |
| 12 | 0.619047 | 0.547453 | 0.472203 | 0.395772 | 0.320892 | 0.250349 | 0.187072 | 0.133082 | 0.089381 |
| 13 | 0.689894 | 0.622389 | 0.548838 | 0.471339 | 0.392481 | 0.315148 | 0.242888 | 0.178675 | 0.124478 |
| 14 | 0.756283 | 0.695179 | 0.626063 | 0.550412 | 0.470350 | 0.388505 | 0.308641 | 0.234609 | 0.169386 |
| 15 | 0.816023 | 0.763201 | 0.701069 | 0.630298 | 0.552258 | 0.468937 | 0.383693 | 0.301060 | 0.224953 |
| 16 | 0.867240 | 0.823795 | 0.770598 | 0.707528 | 0.635124 | 0.554573 | 0.467666 | 0.379269 | 0.293939 |
| 17 | 0.909014 | 0.875161 | 0.831935 | 0.778530 | 0.714692 | 0.640765 | 0.556680 | 0.466460 | 0.374937 |
| 18 | 0.941302 | 0.916479 | 0.883342 | 0.840599 | 0.787350 | 0.723176 | 0.646022 | 0.558721 | 0.465186 |
| 19 | 0.964771 | 0.947815 | 0.924062 | 0.892005 | 0.850335 | 0.798074 | 0.731277 | 0.651320 | 0.560837 |
| 20 | 0.980607 | 0.969958 | 0.954240 | 0.932002 | 0.901840 | 0.862521 | 0.808593 | 0.739812 | 0.657247 |
| 21 | 0.990327 | 0.984232 | 0.974757 | 0.960744 | 0.941016 | 0.914468 | 0.874860 | 0.820274 | 0.750038 |
| 22 | 0.995796 | 0.992673 | 0.987503 | 0.979453 | 0.967629 | 0.951148 | 0.924718 | 0.885682 | 0.832522 |
| 23 | 0.998529 | 0.997166 | 0.994719 | 0.990668 | 0.984419 | 0.975357 | 0.959292 | 0.933795 | 0.896673 |
| 24 | 0.999658 | 0.999204 | 0.998284 | 0.996638 | 0.993949 | 0.989870 | 0.981397 | 0.966511 | 0.943314 |
| 25 | 0.999979 | 0.999893 | 0.999679 | 0.999250 | 0.998500 | 0.997300 | 0.993828 | 0.986626 | 0.974280 |
| 26 | 1.000000 | 1.000000 | 1.000000 | 1.000000 | 1.000000 | 1.000000 | 0.999229 | 0.996914 | 0.992284 |
| 27 | 1.000000 | 1.000000 | 1.000000 | 1.000000 | 1.000000 | 1.000000 | 1.000000 | 1.000000 | 1.000000 |

TABLE III

White 1 to 27, Black 19 to 27

| | Black | | | | | | | | |
|---|---|---|---|---|---|---|---|---|---|
| White | 19 | 20 | 21 | 22 | 23 | 24 | 25 | 26 | 27 |
| 1 | 0.000000 | 0.000000 | 0.000000 | 0.000000 | 0.000000 | 0.000000 | 0.000000 | 0.000000 | 0.000000 |
| 2 | 0.000000 | 0.000000 | 0.000000 | 0.000000 | 0.000000 | 0.000000 | 0.000000 | 0.000000 | 0.000000 |
| 3 | 0.000000 | 0.000000 | 0.000000 | 0.000000 | 0.000000 | 0.000000 | 0.000000 | 0.000000 | 0.000000 |
| 4 | 0.001538 | 0.000621 | 0.000210 | 0.000054 | 0.000008 | 0.000000 | 0.000000 | 0.000000 | 0.000000 |
| 5 | 0.002546 | 0.001079 | 0.000388 | 0.000108 | 0.000019 | 0.000001 | 0.000000 | 0.000000 | 0.000000 |
| 6 | 0.004171 | 0.001856 | 0.000713 | 0.000219 | 0.000045 | 0.000004 | 0.000000 | 0.000000 | 0.000000 |
| 7 | 0.006736 | 0.003147 | 0.001286 | 0.000431 | 0.000104 | 0.000013 | 0.000000 | 0.000000 | 0.000000 |
| 8 | 0.010671 | 0.005215 | 0.002255 | 0.000816 | 0.000221 | 0.000033 | 0.000000 | 0.000000 | 0.000000 |
| 9 | 0.016508 | 0.008401 | 0.003815 | 0.001470 | 0.000434 | 0.000075 | 0.000000 | 0.000000 | 0.000000 |
| 10 | 0.025153 | 0.013313 | 0.006338 | 0.002588 | 0.000825 | 0.000159 | 0.000000 | 0.000000 | 0.000000 |
| 11 | 0.037845 | 0.020895 | 0.010454 | 0.004555 | 0.001596 | 0.000369 | 0.000021 | 0.000000 | 0.000000 |
| 12 | 0.056036 | 0.032349 | 0.017028 | 0.007927 | 0.003062 | 0.000850 | 0.000107 | 0.000000 | 0.000000 |
| 13 | 0.081257 | 0.049044 | 0.027098 | 0.013414 | 0.005643 | 0.001806 | 0.000322 | 0.000000 | 0.000000 |
| 14 | 0.114980 | 0.072414 | 0.041814 | 0.021846 | 0.009860 | 0.003497 | 0.000750 | 0.000000 | 0.000000 |
| 15 | 0.158479 | 0.103843 | 0.062343 | 0.034112 | 0.016304 | 0.006239 | 0.001500 | 0.000000 | 0.000000 |
| 16 | 0.215662 | 0.147675 | 0.092389 | 0.053125 | 0.027015 | 0.011212 | 0.003022 | 0.000000 | 0.000000 |
| 17 | 0.286657 | 0.205634 | 0.135201 | 0.081931 | 0.044662 | 0.020560 | 0.006816 | 0.000772 | 0.000000 |
| 18 | 0.370128 | 0.277986 | 0.192706 | 0.123189 | 0.071674 | 0.036303 | 0.014339 | 0.003086 | 0.000000 |
| 19 | 0.463484 | 0.363684 | 0.265587 | 0.178421 | 0.110247 | 0.060339 | 0.027006 | 0.007716 | 0.000000 |
| 20 | 0.563106 | 0.460538 | 0.353397 | 0.248066 | 0.161574 | 0.094442 | 0.046189 | 0.015432 | 0.000000 |
| 21 | 0.664610 | 0.565423 | 0.454709 | 0.331582 | 0.225903 | 0.139498 | 0.073217 | 0.027006 | 0.000000 |
| 22 | 0.764803 | 0.683070 | 0.588709 | 0.450312 | 0.325908 | 0.217775 | 0.127251 | 0.054784 | 0.000000 |
| 23 | 0.846731 | 0.783724 | 0.708265 | 0.586151 | 0.446368 | 0.319327 | 0.206769 | 0.109568 | 0.027778 |
| 24 | 0.910032 | 0.865780 | 0.810521 | 0.708076 | 0.584530 | 0.441989 | 0.310271 | 0.190586 | 0.083333 |
| 25 | 0.955419 | 0.928713 | 0.893647 | 0.813808 | 0.709984 | 0.583655 | 0.436278 | 0.297068 | 0.166667 |
| 26 | 0.984568 | 0.972994 | 0.956790 | 0.902007 | 0.820988 | 0.714506 | 0.583333 | 0.428241 | 0.277778 |
| 27 | 1.000000 | 1.000000 | 1.000000 | 0.972223 | 0.916667 | 0.833334 | 0.722222 | 0.583333 | 0.416667 |

To determine the probability of black winning simply reverse the positions. For example if white is a 6 and black is at 12 the probability of black winning is the same as the probability of white winning at 12 against black at 6. The probability of a tie is the 1 less the probability of either horse winnings.

For example, consider the case of white on 12 and black on 8. From table 1 we see the probability of white winning is 0.743963. The probability of black winning is the same as white winning from 8 against black at 12. From table 2 this probability is 0.215760. The probability of either horse winning is 0.743963+0.215760=0.959723. The probability of a tie is thus 1−0.95723=0.040277.

The odds in the tables above represent the true odds of a particular piece winning. Note that typically a casino would determine a payout based on the true odds, but take a commission for the house edge. If there was no house commission, of course the casino would just break even in the long run. While the house edge can be chosen to suit the needs of the house, an exemplary house edge of 5% will be used below. The following equations show how to calculate the payoff odds on both bets:

$$\text{White: } (P_b-0.05)/P_w$$

$$\text{Black: } (P_w-0.05)/P_b$$

Where $P_b$=Probability of black win, and
$P_w$=Probability of white win.

For example consider the case again where white is on 12 and black is on 8. The payoff odds on white should be (0.215760−0.05)/0.743963=0.222807. The payoff odds on black should be (0.743963−0.05)/0.215760=3.216365. So a $100 bet from this position should pay $22.28 on white and $321.64 on black. Any rounding of payoffs should typically be down.

The following Tables IV, V and VI show the payoff odds on white from all possible positions. To get the payoff odds on black simply reverse the positions. When the payoff odds are zero no bet should be offered on that side because it is either impossible to win or so likely that even a winning bet would have to lose money to cover the 5% edge.

TABLE IV

Payoff odds, white 1 to 27, black 1 to 9

| | Black | | | | | | | | |
|---|---|---|---|---|---|---|---|---|---|
| White | 1 | 2 | 3 | 4 | 5 | 6 | 7 | 8 | 9 |
| 1 | 0.895523 | 1.162974 | 1.515979 | 1.988385 | 2.630723 | 3.520225 | 0.000000 | 0.000000 | 0.000000 |
| 2 | 0.686948 | 0.895434 | 1.168913 | 1.532110 | 2.021494 | 2.692089 | 3.629007 | 4.967165 | 6.926671 |
| 3 | 0.520706 | 0.683213 | 0.895339 | 1.175250 | 1.549432 | 2.057335 | 2.759175 | 3.749162 | 5.178628 |
| 4 | 0.388313 | 0.514770 | 0.679268 | 0.895239 | 1.182024 | 1.568071 | 2.096264 | 2.832786 | 3.882453 |
| 5 | 0.283159 | 0.381210 | 0.508528 | 0.675099 | 0.895132 | 1.189267 | 1.588207 | 2.138733 | 2.913913 |
| 6 | 0.200032 | 0.275620 | 0.373772 | 0.501961 | 0.670690 | 0.895018 | 1.197061 | 1.610074 | 2.185327 |
| 7 | 0.000000 | 0.192569 | 0.267758 | 0.365977 | 0.495039 | 0.666004 | 0.894895 | 1.205500 | 1.634033 |
| 8 | 0.000000 | 0.127758 | 0.184825 | 0.259552 | 0.357790 | 0.487712 | 0.660997 | 0.894763 | 1.214769 |
| 9 | 0.000000 | 0.077734 | 0.120508 | 0.176789 | 0.250983 | 0.349169 | 0.479906 | 0.655579 | 0.894619 |
| 10 | 0.000000 | 0.039679 | 0.071221 | 0.113034 | 0.168456 | 0.242030 | 0.340069 | 0.471571 | 0.649763 |
| 11 | 0.000000 | 0.011260 | 0.034041 | 0.064555 | 0.105340 | 0.159816 | 0.232658 | 0.330441 | 0.462682 |
| 12 | 0.000000 | 0.000000 | 0.006556 | 0.028321 | 0.057750 | 0.097426 | 0.150838 | 0.222807 | 0.320205 |
| 13 | 0.000000 | 0.000000 | 0.000000 | 0.001835 | 0.022539 | 0.050815 | 0.089271 | 0.141458 | 0.212348 |
| 14 | 0.000000 | 0.000000 | 0.000000 | 0.000000 | 0.000000 | 0.016720 | 0.043746 | 0.080821 | 0.131532 |
| 15 | 0.000000 | 0.000000 | 0.000000 | 0.000000 | 0.000000 | 0.000000 | 0.010888 | 0.036535 | 0.071978 |
| 16 | 0.000000 | 0.000000 | 0.000000 | 0.000000 | 0.000000 | 0.000000 | 0.000000 | 0.005022 | 0.029074 |
| 17 | 0.000000 | 0.000000 | 0.000000 | 0.000000 | 0.000000 | 0.000000 | 0.000000 | 0.000000 | 0.000000 |
| 18 | 0.000000 | 0.000000 | 0.000000 | 0.000000 | 0.000000 | 0.000000 | 0.000000 | 0.000000 | 0.000000 |
| 19 | 0.000000 | 0.000000 | 0.000000 | 0.000000 | 0.000000 | 0.000000 | 0.000000 | 0.000000 | 0.000000 |
| 20 | 0.000000 | 0.000000 | 0.000000 | 0.000000 | 0.000000 | 0.000000 | 0.000000 | 0.000000 | 0.000000 |
| 21 | 0.000000 | 0.000000 | 0.000000 | 0.000000 | 0.000000 | 0.000000 | 0.000000 | 0.000000 | 0.000000 |
| 22 | 0.000000 | 0.000000 | 0.000000 | 0.000000 | 0.000000 | 0.000000 | 0.000000 | 0.000000 | 0.000000 |
| 23 | 0.000000 | 0.000000 | 0.000000 | 0.000000 | 0.000000 | 0.000000 | 0.000000 | 0.000000 | 0.000000 |
| 24 | 0.000000 | 0.000000 | 0.000000 | 0.000000 | 0.000000 | 0.000000 | 0.000000 | 0.000000 | 0.000000 |
| 25 | 0.000000 | 0.000000 | 0.000000 | 0.000000 | 0.000000 | 0.000000 | 0.000000 | 0.000000 | 0.000000 |
| 26 | 0.000000 | 0.000000 | 0.000000 | 0.000000 | 0.000000 | 0.000000 | 0.000000 | 0.000000 | 0.000000 |
| 27 | 0.000000 | 0.000000 | 0.000000 | 0.000000 | 0.000000 | 0.000000 | 0.000000 | 0.000000 | 0.000000 |

TABLE V

Payoff odds, white 1 to 27, Black 10 to 18

| | Black | | | | | | | | |
|---|---|---|---|---|---|---|---|---|---|
| White | 10 | 11 | 12 | 13 | 14 | 15 | 16 | 17 | 18 |
| 1 | 0.00000 | 0.00000 | 0.00000 | 0.00000 | 0.00000 | 0.00000 | 0.00000 | 0.00000 | 0.00000 |
| 2 | 9.87814 | 14.46837 | 21.87019 | 0.00000 | 0.00000 | 0.00000 | 0.00000 | 0.00000 | 0.00000 |
| 3 | 7.29844 | 10.53889 | 15.66663 | 24.10448 | 38.61877 | 64.89750 | 115.415 | 219.609 | 453.227 |
| 4 | 5.41618 | 7.72244 | 11.30612 | 17.08718 | 26.81755 | 44.01580 | 76.21487 | 140.727 | 280.802 |
| 5 | 4.03096 | 5.68445 | 8.20911 | 12.20389 | 18.78639 | 30.14829 | 50.86876 | 91.19742 | 175.988 |
| 6 | 3.00373 | 4.19732 | 5.98947 | 8.77241 | 13.26389 | 20.83715 | 34.28980 | 59.71548 | 111.437 |

TABLE V-continued

Payoff odds, white 1 to 27, Black 10 to 18

| | Black | | | | | | | | |
|---|---|---|---|---|---|---|---|---|---|
| White | 10 | 11 | 12 | 13 | 14 | 15 | 16 | 17 | 18 |
| 7 | 2.23673 | 3.10381 | 4.38526 | 6.33984 | 9.43174 | 14.52798 | 23.34957 | 39.54311 | 71.41772 |
| 8 | 1.66040 | 2.29377 | 3.21637 | 4.60030 | 6.74860 | 10.21475 | 16.06852 | 26.51827 | 46.45157 |
| 9 | 1.22487 | 1.68944 | 2.35761 | 3.34499 | 4.85182 | 7.23675 | 11.17461 | 18.02633 | 30.72880 |
| 10 | 0.89446 | 1.23578 | 1.72120 | 2.42872 | 3.49125 | 5.14344 | 7.81345 | 12.34482 | 20.51540 |
| 11 | 0.64358 | 0.89429 | 1.24755 | 1.75609 | 2.50848 | 3.65913 | 5.48090 | 8.49738 | 13.78424 |
| 12 | 0.45329 | 0.63703 | 0.89411 | 1.26042 | 1.79519 | 2.60065 | 3.85198 | 5.87559 | 9.32351 |
| 13 | 0.30942 | 0.44336 | 0.63001 | 0.89392 | 1.27500 | 1.84135 | 2.70712 | 4.07740 | 6.35132 |
| 14 | 0.20138 | 0.29805 | 0.43269 | 0.62223 | 0.89370 | 1.29280 | 1.89581 | 2.83319 | 4.35308 |
| 15 | 0.12124 | 0.18987 | 0.28578 | 0.42067 | 0.61295 | 0.89338 | 1.31504 | 1.96228 | 2.99252 |
| 16 | 0.06295 | 0.11068 | 0.17788 | 0.27262 | 0.40723 | 0.60171 | 0.89309 | 1.33594 | 2.02771 |
| 17 | 0.02155 | 0.05383 | 0.09987 | 0.16528 | 0.25831 | 0.39181 | 0.59149 | 0.89281 | 1.35682 |
| 18 | 0.00000 | 0.01403 | 0.04458 | 0.08860 | 0.15163 | 0.24192 | 0.37760 | 0.58157 | 0.89252 |
| 19 | 0.00000 | 0.00000 | 0.00653 | 0.03504 | 0.07642 | 0.13593 | 0.22654 | 0.36335 | 0.57080 |
| 20 | 0.00000 | 0.00000 | 0.00000 | 0.00000 | 0.02485 | 0.06243 | 0.12080 | 0.21037 | 0.34688 |
| 21 | 0.00000 | 0.00000 | 0.00000 | 0.00000 | 0.00000 | 0.01350 | 0.04845 | 0.10387 | 0.19027 |
| 22 | 0.00000 | 0.00000 | 0.00000 | 0.00000 | 0.00000 | 0.00000 | 0.00338 | 0.03605 | 0.08791 |
| 23 | 0.00000 | 0.00000 | 0.00000 | 0.00000 | 0.00000 | 0.00000 | 0.00000 | 0.00000 | 0.02417 |
| 24 | 0.00000 | 0.00000 | 0.00000 | 0.00000 | 0.00000 | 0.00000 | 0.00000 | 0.00000 | 0.00000 |
| 25 | 0.00000 | 0.00000 | 0.00000 | 0.00000 | 0.00000 | 0.00000 | 0.00000 | 0.00000 | 0.00000 |
| 26 | 0.00000 | 0.00000 | 0.00000 | 0.00000 | 0.00000 | 0.00000 | 0.00000 | 0.00000 | 0.00000 |
| 27 | 0.00000 | 0.00000 | 0.00000 | 0.00000 | 0.00000 | 0.00000 | 0.00000 | 0.00000 | 0.00000 |

TABLE VI

Payoff odds, white 1 to 27, black 19 to 27

| | Black | | | | | | | | |
|---|---|---|---|---|---|---|---|---|---|
| White | 19 | 20 | 21 | 22 | 23 | 24 | 25 | 26 | 27 |
| 1 | 0.00000 | 0.00000 | 0.00000 | 0.00000 | 0.00000 | 0.00000 | 0.00000 | 0.00000 | 0.00000 |
| 2 | 0.00000 | 0.00000 | 0.00000 | 0.00000 | 0.00000 | 0.00000 | 0.00000 | 0.00000 | 0.00000 |
| 3 | 0.00000 | 0.00000 | 0.00000 | 0.00000 | 0.00000 | 0.00000 | 0.00000 | 0.00000 | 0.00000 |
| 4 | 616.2 | 1528 | 4520 | 17703 | 120423 | 0.00000 | 0.00000 | 0.00000 | 0.00000 |
| 5 | 371.6 | 879.0 | 2445 | 8770 | 50742 | 1595631 | 0.00000 | 0.00000 | 0.00000 |
| 6 | 226.3 | 510.2 | 1331 | 4344 | 21008 | 265936 | 0.00000 | 0.00000 | 0.00000 |
| 7 | 139.6 | 300.4 | 737.1 | 2201 | 9136 | 75980 | 0.00000 | 0.00000 | 0.00000 |
| 8 | 87.59882 | 180.7 | 419.7 | 1163 | 4297 | 28491 | 0.00000 | 0.00000 | 0.00000 |
| 9 | 56.14576 | 111.6 | 247.5 | 644.8 | 2188 | 12662 | 0.00000 | 0.00000 | 0.00000 |
| 10 | 36.38859 | 69.92286 | 148.4 | 365.5 | 1150 | 5974 | 0.00000 | 0.00000 | 0.00000 |
| 11 | 23.74255 | 44.04934 | 89.38969 | 207.0 | 593.5 | 2572 | 44318 | 0.00000 | 0.00000 |
| 12 | 15.61606 | 27.97372 | 54.33310 | 118.3 | 308.6 | 1115 | 8862 | 0.00000 | 0.00000 |
| 13 | 10.37874 | 18.00325 | 33.63121 | 69.31429 | 166.7 | 524.3 | 2953 | 0.00000 | 0.00000 |
| 14 | 6.97573 | 11.78120 | 21.32972 | 42.02891 | 94.79411 | 270.0 | 1264 | 0.00000 | 0.00000 |
| 15 | 4.73404 | 7.84071 | 13.88494 | 26.43901 | 56.78097 | 150.7 | 631.4 | 0.00000 | 0.00000 |
| 16 | 3.17131 | 5.15172 | 8.94585 | 16.48613 | 33.68450 | 83.10811 | 312.4 | 0.00000 | 0.00000 |
| 17 | 2.10852 | 3.36783 | 5.71372 | 10.21964 | 19.81273 | 44.60991 | 137.5 | 1227.4 | 0.00000 |
| 18 | 1.38949 | 2.19610 | 3.64753 | 6.37018 | 11.83486 | 24.63531 | 64.49885 | 305.4 | 0.00000 |
| 19 | 0.90000 | 1.42092 | 2.32730 | 4.02218 | 7.24629 | 14.27793 | 33.55888 | 121.2 | 0.00000 |
| 20 | 0.56356 | 0.90000 | 1.46997 | 2.56590 | 4.55803 | 8.65892 | 19.05142 | 59.84751 | 0.00000 |
| 21 | 0.32963 | 0.54376 | 0.90000 | 1.63668 | 2.92850 | 5.46976 | 11.54523 | 33.60710 | 0.00000 |
| 22 | 0.17163 | 0.29501 | 0.48507 | 0.90000 | 1.65859 | 3.03884 | 6.02553 | 15.59155 | 0.00000 |
| 23 | 0.07369 | 0.14585 | 0.25301 | 0.47821 | 0.90000 | 1.68898 | 3.21202 | 7.06831 | 31.29999 |
| 24 | 0.01299 | 0.05363 | 0.11350 | 0.24218 | 0.46898 | 0.90000 | 1.73706 | 3.51155 | 9.45001 |
| 25 | 0.00000 | 0.00000 | 0.02783 | 0.09855 | 0.22667 | 0.45502 | 0.90000 | 1.81545 | 4.06666 |
| 26 | 0.00000 | 0.00000 | 0.00000 | 0.00770 | 0.07679 | 0.20340 | 0.43380 | 0.90000 | 1.94500 |
| 27 | 0.00000 | 0.00000 | 0.00000 | 0.00000 | 0.00000 | 0.04500 | 0.16923 | 0.40238 | 0.90000 |

The above tables were calculated with the following parameters: 27 slots, 2 pieces, and a six sided die. Of course, the invention is not limited to these particular parameters.

Payouts can also be posted in terms of taking and laying odds, as is commonly done in sports betting. This can be computed by:

Let $x=(1-p-h)/p$, where $x$ is the payout odds;

If $x>=1$ then the player would take+100*$x$,

If $x<1$ then the player would lay−100/$x$.

In a further embodiment of the invention, more exotic real time bets can be placed. For example, an exacta real time bet can be placed in real time. An exacta bet is where a player chooses the first and second piece to finish the race, in the proper order. In the present invention, real time odds for exacta bets can be computed using the method described above. When a simulation is run, the odds of a particular exacta combination winning can be calculated as equal to the total number of times two selected horses finish first (in the order chosen)/the total number of progressions in the simulation. The payout that is output is typically the true odds adjusted for the house commission (to be explained in more detail below).

Similarly, a quinella bet can be placed in real time. This is where the player picks the first and second piece to finish the race, but in either order. Again, as discussed above, a simulation can determine the odds that two selected pieces will comprise a winning quinella bet.

Further, a triple bet can be placed in real time. A triple is where the player picks the first three pieces to finish the race, in the correct order. Again, the methods described above can be used to calculate the odds and payout for 3 pieces selected by the player.

Moreover, bets can be offered requiring a player to select any number of pieces to finish the progression first. The exact order may be required (i.e. an exacta bet), or the bet may allow any order (i.e. a quinella bet) as long as all of the selected pieces finish the race first. Thus, even a "pick 6" bet can be offered in real time using the methods described above, which require the player to correctly pick to win in proper order. Thus, a "pick 6" bet towards the beginning of the progression (so it is difficult to determine which pieces will win) should typically have a very large payout.

The odds for the above exotic bets may be pre-computed and stored in tables such as those presented above for later reference or they may be computed in real time. Of course, the larger the number of pieces in a progression and the larger the number of pieces selected for a bet on the progression, the larger the size and number of tables needed. Depending on the particular parameters of the game selected, and the computing platform used, the system administrators can choose an appropriate method (pre-storing or computing in real time). With three or more horses, a random simulation over the recursive simulation is generally recommended since the recursive simulation may take too much time, but this depends on the computing platform and particularities of the system.

Once the simulation has determined the probability of a particular bet winning, the payoff odds for any bet can be computed as:

$$(1-p-h)/p$$

Where p=probability of win and h=house edge. For example if the probability of winning is 23% and the house edge is 6% then the payoff odds should be (1−0.23−0.06)/0.23=3.087.

In a further embodiment of the present invention, the house edge can not just be fixed, but can be adjusted by applying a variable commission on the true odds to compute the posted odds. The variable commission can be determined by various factors. For example, the house may wish to apply a reduced commission as the volume of the player's wagers increases. As a further example, the variable commission may be based on a particular bet's chances of winning or losing.

There can be many ways to compute a variable commission. One such way is to use the following formula:

$$\text{Variable commission}=\text{chance of bet winning}*\text{maximum commission}$$

For example, if the maximum commission is set to be 10%, and the chance of a particular bet winning is determined to be 75%, the variable commission would be 7.5%. This formula increases the variable commission in direct relation to the chances of the bet winning. If the house wants to decrease the variable commission in relation to the chances of the bet winning, the following formula can be used:

$$\text{Variable commission}=(1-\text{chance of bet winning})*\text{maximum commission}.$$

Of course, the above formulas are merely examples of one way to vary the house commission based on the chances of a particular bet winning. Alternatively, a commission pay table can be used which contains a range of chances of a bet winning and a respective house commission.

Another type of bet would be a "surrender" bet. During a progression, if a player changes his or her mind, and no longer wishes to maintain their bet, the player can surrender their bet and receive a cash value. The cash value of the bet is computed based on the expected value that the bet will return. This expected value can be computed using similar methods to that described above. A large number of progression simulations can be run, and each time the bet in question wins and loses is tabulated (including the respective payout information) and a running total is kept of the current win/loss amounts. Thereafter, an average can be taken. For example, if a player wagers on a particular piece, and it is determined that the wager has an expected value of 50% of the original bet, the surrender value of the wager is 50% of the original wager. This is not taking into consideration a house commission, and the surrender value can be deducted for the house commission. For example, if a player wagers $100, and the surrender value is determined to be 50% or $50, the surrender value can then be multiplied by a surrender commission chosen by the casino (i.e. 5%), which can be deducted from the original, resulting in a resulting surrender value of $47.50.

In another embodiment of the present invention, the playing field can include a bonus slot (an example can be found in FIG. 1, item 116). If a player wagers on a particular piece (either a win bet or an exotic bet) which lands exactly on the bonus slot, the player can be entitled to a special bonus, for example a 10% payout bonus on his bet or bets involving the piece. Typically, if this type of bonus is offered, the house commission would have to be raised to compensate for giving up the bonus. The bonus slot can be chosen automatically at random, or it can even be chosen by a player. This embodiment can be implemented during operation 204 of FIG. 2. After the piece is advanced, a check can be performed to determine whether or not the piece falls on a bonus square. If so, some type of bonus flag may be set (regardless of whether the game is implemented electronically or as a table game) so that the respective payouts are adjusted if the piece actually wins the progression.

In a further embodiment of the invention, a bet can be made not on the outcome of the progression, but on the rolls of the next die or dice. This is similar to a "field" bet in craps, which bets on the outcome of the next roll, but not on whether the shooter wins or loses his original wager. For example, a bet can be made that the next roll of a die (or any other advancing mechanism) will be a particular number. A bet can also be made on the next roll of a plurality of dice (for example, the red die will roll 5, the black die will roll 2). A bet can also be made on the sum of the next roll of all of the dice. In this way, additional excitement can be achieved by offering a bet which does not require waiting until the progression finishes. The payout on these type of bets can be calculated using and standard method. For example, the true odds of an occurrence happening can be calculated, and the payout reflect the true odds but adjusted for a house commission (see above).

In a yet further embodiment of the invention, a bet can be made on how many times the advancing mechanism is needed before a particular piece passes the finish line. For example, in the embodiment which uses a simulated horse-race as the progression and uses dice as the advancing mechanism, a player can wager that exactly 5 rolls of the die will be needed before the red horse finishes the race. The odds of this bet can be computed using the simulation described herein (which would also be programmed to include a counter for the advancing mechanism so this can be tabulated) and the payout can be computed using the formulas herein based on the odds.

In an additional embodiment of the invention for use with an electronic version of the game, a "multi line" version can be implemented, not completely unlike the game known in the art as "multi line video poker." In multi line video poker, a player receives a hand, then the hand is split into multiple hands (i.e. 5) and each multiple hand is played separately. Thus, this divides the current game into multiple games with multiple outcomes, giving the player the excitement of playing multiple games at the same time with a common originator.

In the present invention, after a progression has commenced, at any division the player can choose to play multiple resolutions (also called "multiple progressions" or outcomes) of the progression. Each resolution is the progression continued until it is finished. For example, midway through a progression, a player decides to make any of the bets described herein and also play 2 (or more) multi-progressions. The computer then continues the progression as normal. Then, the computer restarts the progression from the point that the multi-progression bet is made and continues the progression again using completely new random numbers. This would continue until the desired amount of multiple progressions has been completed. In the alternative, all of the multiple progressions can be run simultaneously. The player would of course need to make an additional money bet for each of the addition multiple progression(s). Once all of the multiple progressions have been completed, the system takes an accounting and pays/takes all of the wagers accordingly. Thus for example, if a player bets on a black piece in a two piece progression, and black is in the lead, the player may wish to play 5 multi-progressions, with the belief that he will win most of the bets since his piece is in the lead. However, the payout on the multi progression bets is as calculated above (using real time payouts), which typically always has an advantage to the party taking the bets (the house). Thus, any such additional bets will be encouraged by the house. So in the example above where the player's piece is in the lead, if this piece actually wins the player will receive a higher payout on the original bet than on the multi progression bets. This is because the odds for the original bet were calculating before the progression began, assuming each piece has an equal chance of winning. However, if one piece is in the lead when a multi progression bet is initiated, the payout must be adjusted accordingly so the house still has an advantage on all of the multi progressions. Also, during any of the multi progressions, the player can make any bet described herein and can play each multi progression as a regular progression.

One implementation of a multi progression embodiment may, upon a player's designation that a multi progression is desired, automatically copy the current status of the progression into computer memory slots (one memory slot for each desired multi progression). Then, each memory slot is cycled through and the progression stored therein is then implemented as described herein. When all progressions are completed, accounting is made of all of the wagers therein.

In a further embodiment also intended for an electronic version of the game, the player can automatically parlay his wager on numerous different progressions. For example, the player can choose a particular wager, and choose to make the same wager for the next 2 (or any number) of progressions. The player can also choose to wager the same amount on each of the progressions, or the player can choose to automatically parlay (add the winnings) on to the next progression. Thus, in the latter case, the player can choose to wager $10 that a black piece will win, and parlay this same wager 2 times. If the first bet wins (and assuming it pays even money), the system will automatically wager $20 on black to win for the next progression. If the second bet wins, the system will automatically wager $40 (the winnings) on black to win for the next progression. If the third bet wins, the system will stop and credit the player with his money. Note the difference between this type of bet and the multi line bet described above. The multi line bet takes place after the progression has begun and typically does not parlay winnings into future bets. In contrast, this parlay bet is made before a progression has begun and automatically parlays (adds the winnings onto) the future bets.

In yet a further embodiment of the present invention, automatic advertising could be used to advertise certain bets. For example, if a player bet on a white piece in a two piece race, and the white horse is leading a remaining black piece by an appropriate margin, a hedge bet can be advertised. The player can be informed that if he places a bet on the black piece, he would be guaranteed to make a profit on the progression. This is because if the white piece wins he will win his original bet. If he now bets on the black piece, and this piece wins, since the black piece is trailing the white piece the payout for the black piece would be greater than on the white piece. Thus, by now betting on the black piece, by betting on both pieces the player can be guaranteed to win money. Of course, the house takes a commission on such advertised bets and it is not really in the player's mathematical advantage to make such a hedge bet, because at the time of the bet the player's expected win (because his piece happens to be winning) would typically be higher than if he goes ahead and makes such a hedge bet. However, such aggressive advertising may generate more wagers from the players who typically like when there is a "sure thing." The concept of hedging bets is known in the art. Besides advertising hedging bets, the system may also advertise any other bet which a player may find appealing.

An automated advertisement could be generated upon any predetermined condition set by the party taking the bets. The system or method could check if a current player's bets fall into any of the predetermined conditions in order to offer such an advertisement. For example, if a player's expected value is greater than a certain threshold, then this could trigger an advertisement to bet on pieces not already bet on. As a further example, consider a two piece progression. If a player bets on a single piece, and the expected value of the player's bet is over a predetermined threshold (i.e. the player's piece is winning), then an advertisement could pop up offering a hedging bet on the losing piece. The advertisement could display odds and payouts as determined using the methods described herein.

The above described method of wagering can be implemented in numerous embodiments. In one embodiment, the method or game can be played as a table game, where a live human dealer can offer and receive wagers, carry out the progression (i.e. roll dice and move pieces), and when the progression is complete take accounting of the wagers. A digital computer can be used to assist the calculating of the real time odds, and these real time odds can be displayed on a monitor. In this embodiment, the dealer can proceed to the next division of the progression when it is clear that no player desires to make a further bet.

In another embodiment, the method or game can be implemented by an electronic gaming device. One example of an electronic gaming device is a video poker machine, which electronically takes money in the form of cash or a debit card, uses digital computer technology, and LCD screen, and standard input/output devices to carry out the game, and can pay money either electronically or physically. An electronic gaming device can be used to implement the method described herein, which would electronically take initial bets, display the progression, compute and display the live odds during the progression, take real time bets, complete the progression, and take accounting of the wagers. In this embodiment, a player can indicate on the computer when he is ready to advance the progression to the next division.

In a further embodiment, the wagering method described herein can be implemented as a parlor game. A collection of electronic gaming devices can be grouped together in a parlor, and the progression can be displayed on a large scale for all the players to watch such as on a big screen. Also, runners can be used to collect bets from patrons, similar to "keno runners."

Figure 6:
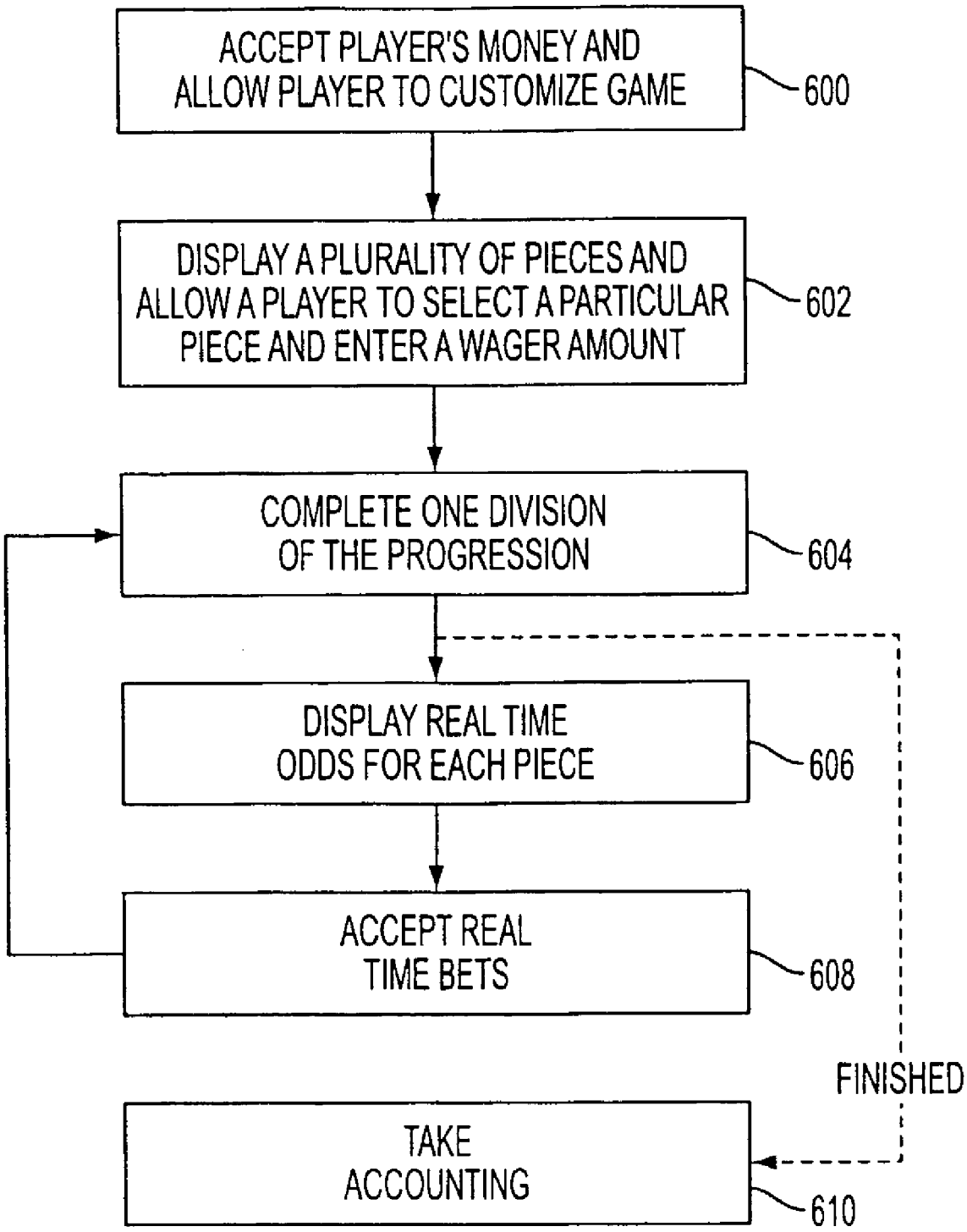
FIG. 6 is a flowchart illustrating one example of a user interface that an electronic gaming device would use to implement the wagering method, according to an embodiment of the present invention.

FIG. 6 is a flowchart illustrating one example of a user interface that an electronic gaming device would use to implement the wagering method.

The method starts with operation 600, which accepts a player's money and allows the player to customize the game. Money can be paid in the form of cash or an electronic debit card. The player also has the option to customize the game. For example, the player can choose how many slots the playing field has, how many pieces are used, a theme the game uses (i.e. pie eating contest or horserace), and whether the player wishes to play a multi line game (see below for more details on this).

From operation 600, the method proceeds to operation 602, which allows displays a plurality of pieces and allows a player to select a particular piece and enter a wager amount. The player can wager on as many pieces as he desires. The player can also place any type of exotic bet he wishes (see below). When the player desires to begin the progression, the player can proceed by pressing a button. Input into the electronic gaming device can be in the form of a keyboard, specially designed keys, or a touch screen embedded on an output device (i.e. an LCD).

From operation 602, the method proceeds to operation 604, which completes one division of the progression. It can be determined whether the progression should be finished by checking if all of the pieces that affect active bets on them have completed the progression. If this is the case, then the method proceeds to operation 610. In the alternative, the progression can be considered finished when all pieces in the progression have passed the finish line.

If the progression is not finished, then from operation 604, the progression proceeds to operation 606, which displays real time odds for each piece. The real time odds are calculated using the methods discussed herein or a conventional method. This also can include displaying any advertisements (as discussed above), and can also include displaying or implementing any other embodiment or option discussed herein.

From operation 606, the operation proceeds to operation 608, which accepts real time bets. The player may optionally select a piece in the display from operation 606 in which he wishes to place a real time bet. He can also enter an amount of money he wishes to wager on this piece. Actual methods of accepting bets will be described below. The method then returns to operation 604 where the progression is continued.

When the progression is completed, the method proceeds to operation 610, which takes accounting. Losing bets are taken and winnings bets are paid according to the computed odds. Then, the method can return to operation 600 where a brand new progression can take place (not pictured).

Of course, the above described a simplified user interface for the electronic gaming device, but a manufacturer may tailor the interface as he or she finds appropriate.

FIGS. 7A, 7B, 7C, 7D, 7E, and 7E illustrate screen shots of sample output screens on the electronic gaming device.

Figure 7A:
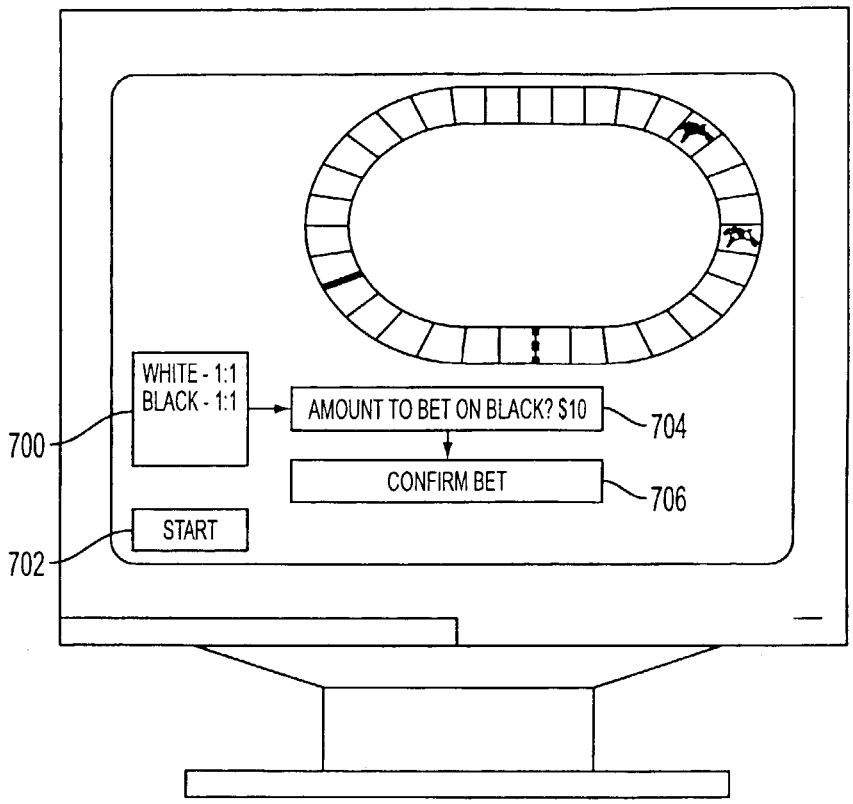
FIG. 7A illustrates an initial screen where pieces are listed and initial odds displayed, according to an embodiment of the present invention.

FIG. 7A illustrates an initial screen where pieces are listed and initial odds displayed, and corresponds to operation 602. A piece list 700 displays all the active pieces and their corresponding odds. A start button 702 allows a player to start the progression. If a player selects a particular piece, an amount window 704 is displayed which prompts the player to enter an amount to bet. In this case piece white is selected. A confirm bet button 706 is displayed so the player can actually place his bet.

Figure 7B:
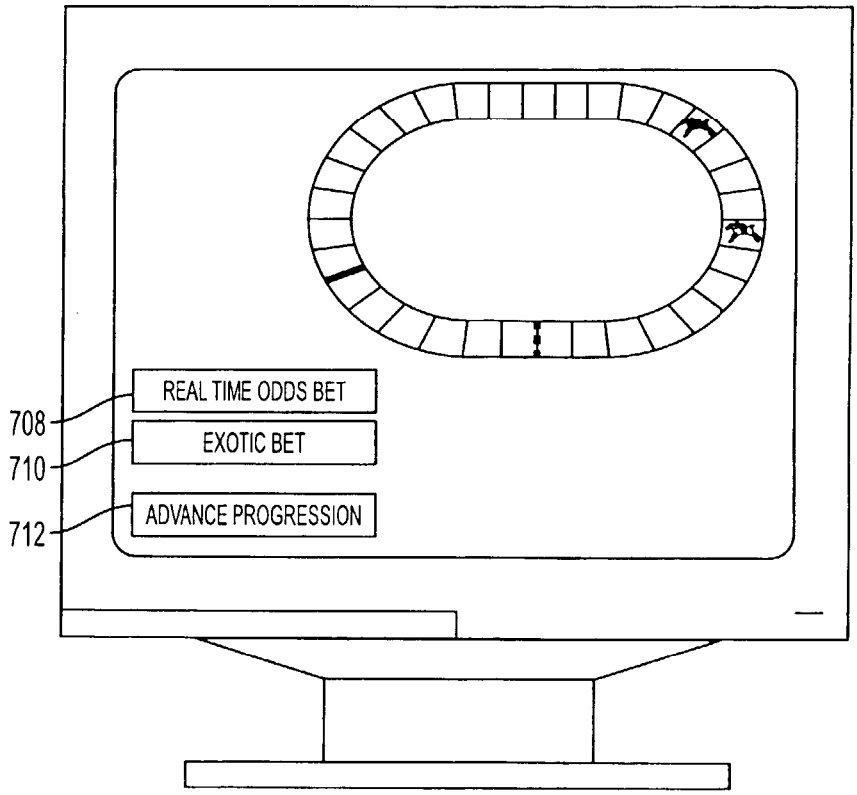
FIG. 7B illustrates a division screen, according to an embodiment of the present invention.

FIG. 7B illustrates a division screen, which corresponds to operation 604, in which a division of the progression is implemented. For example, if the progression relates to a horserace, the horse pieces will advance around the track. Of course, using fancy graphics, catchy animation, and sound effects are encouraged to make the experience an enjoyable one for the player. Also illustrated is a real time odds bet button 708; an exotic bet button 710, and an advance progression button 712, which will display FIGS. 7C, 7D, or advance the progression respectively. Also not pictured is an advancing mechanism.

Figure 7C:
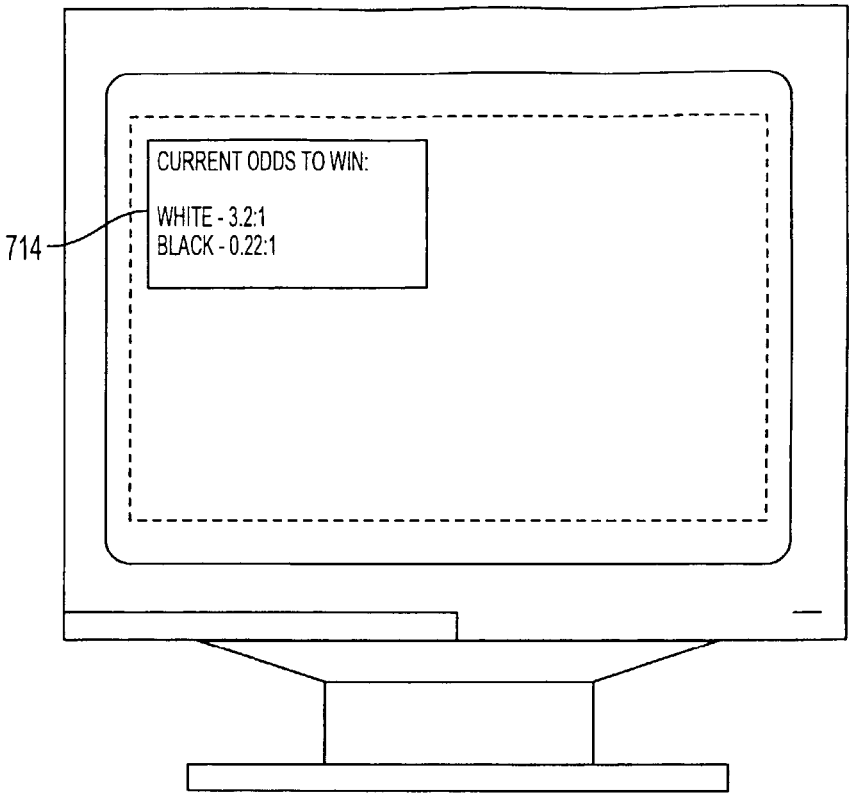
FIG. 7C illustrates a real time odds display screen, which corresponds to operation 606, according to an embodiment of the present invention.

FIG. 7C illustrates a real time odds display screen, which corresponds to operation 606. The computed real time odds are displayed in a real time odds window 714. Real time bets on pieces can be made in the same manner as illustrated in FIG. 7A.

Figure 7D:
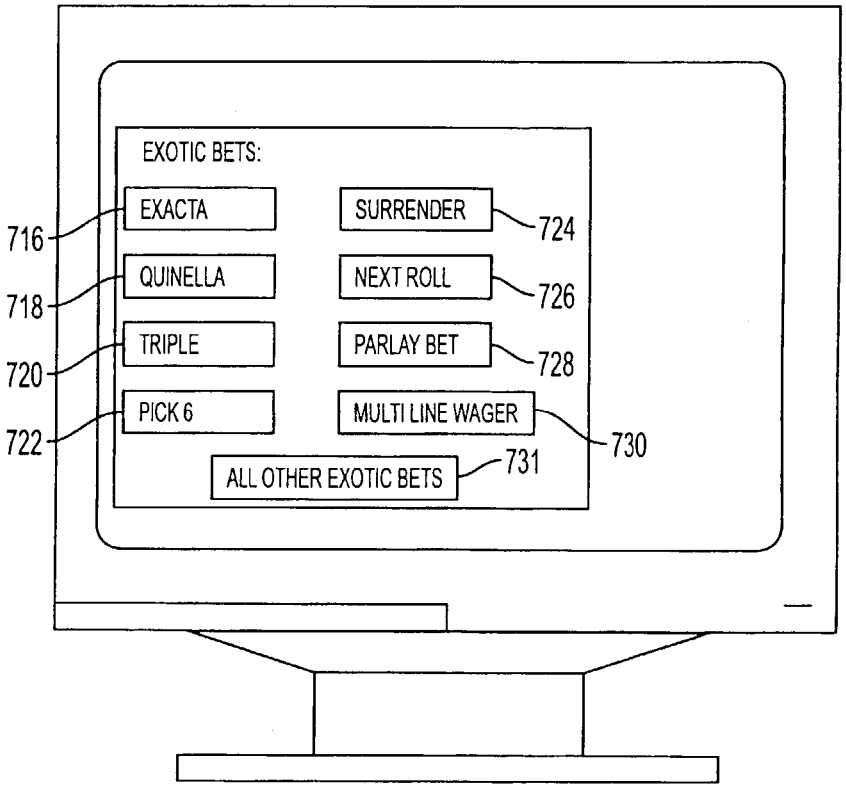
FIG. 7D illustrates an exotic bet display screen, according to an embodiment of the present invention.

FIG. 7D illustrates an exotic bet display screen. A player can select an exotic bet he or she wishes to make Illustrated is an exacta wager button 716, a quinella wager button 718, a triple wager button 720, a pick six wager button 722, a surrender wager button 724, a next roll wager button 726, a parlay bet button 728, a multi line wager button 730, and an all other exotic bets button 731. For example, if the player presses the exacta wager button 716, the player will then be prompted two enter in two horses (not pictured). Note that pressing the exacta wager button 716, the quinella wager button 718, the triple wager button 720, or the pick six wager button 722 can produce a screen (not pictured) asking for the particular pieces to make the respective wager with. In the alternative, particular buttons for some of these bets need not be displayed, and a general system for taking such bets as described below and illustrated in FIG. 7E can be implemented.

When the surrender wager button 724 is pressed, a window (not pictured) can appear listing the active wagers and each wager's surrender value, upon which a player can select a wager can accept the surrender value. When the next roll wager button 726 is pressed, a window (not pictured) can appear prompting the player to enter what he predicts the next roll will be and how much he wishes to wager on it. The bet can be made on a roll of a particular advancing mechanism (i.e. a black die) or the sum total of all mechanisms used (i.e. all the dice). The respective odds for each bet will be displayed also. When the parlay bet button 728 is pressed, a window (not pictured) can appear prompting for a particular bet, how many progressions the player wishes to parlay, and a parlay amount. When the multi line wager button 730 is pressed, a window (not pictured) can appear prompting the player to choose how many multi lines the player wishes, and how much to bet on the multi lines (typically all of the live bets will be copied over to the multi lines). The all other exotic bets button 731 can be used to wager on any other type of bet not illustrated in FIG. 7D. It is again noted that all of the configurations described herein are meant to be one example, but one skilled in the art can program a computer to input and output any desired or required information to/from the player, including information not provided in the examples herein.

Figure 7E:
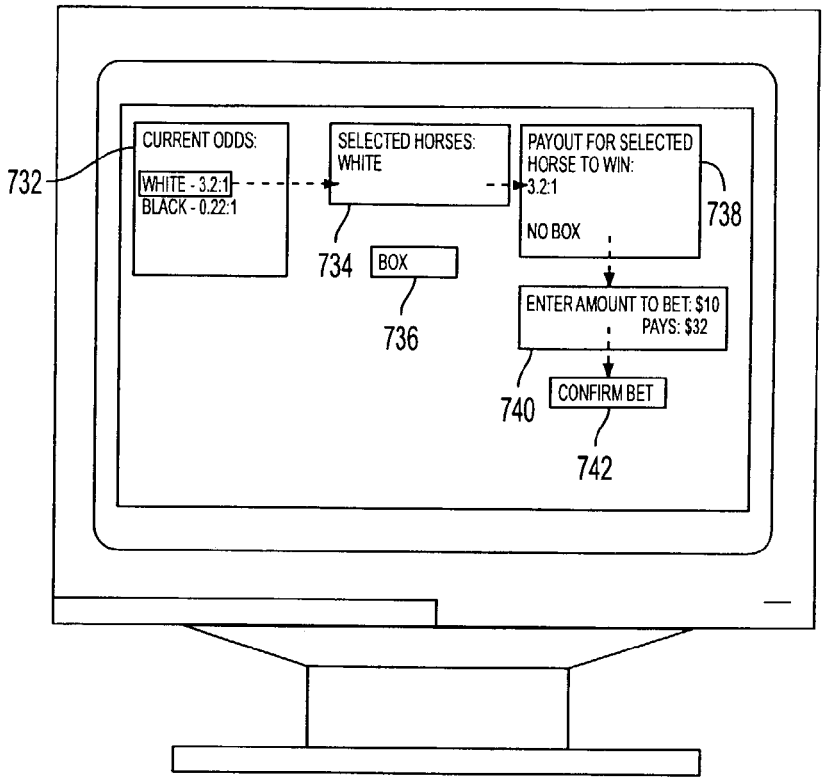
FIG. 7E illustrates an example of placing various types of wagers on a wagering screen, according to an embodiment of the present invention.

FIG. 7E illustrates an example of placing various types of wagers on a wagering screen. A piece list 732 displays the active pieces and optionally their current odds to win (these odds can be calculated using any of the methods described above). When the player selects pieces from the piece list 732, the selected pieces appear in a selection window 734. In this example, white is selected. The player can select more than one horse, and each horse selected would appear in the selection window 734 in the order selected. Thus, the player must be careful to select the horses in the proper order if he wishes to make a bet which requires the finishing order to be exact. A payout window 738 appears displaying the payout for this number of selected horse(s) to finish in the same selected order. The player may also select the box button 736 to "box" the selected horses so that the bet wins by finishing in any order (of course this would have lower odds than betting if the horses would finish in the same order chosen). "Boxing" is well known in the art. For example, a quinella bet (where two selected horses finish first but in either order) could be made by selecting 2 horses and then selecting the box button. If the box is not selected, then the bet is an exacta bet (where two selected horses finish first but in the selected order). If two horses were selected, then the payout for this two horse bet would be displayed in the payout window 738. Of course, in the example displayed, the race only uses two horses so these types of bets (exacta, quinella) do not apply, and a box could not be applied. The player can enter the amount he wishes to bet in an amount window 740, which can then automatically display the amount that bet will pay if it wins. Whether or not the selected horses are boxed appears in the amount window. The play can then confirm the bet by pressing the confirm bet button 742. Bets for the other wagers can be placed similarly.

The flow of windows from FIG. 7E can be illustrates as follows. The piece list 732 is automatically displayed. When a piece is selected from the piece list 732, the selection window 734 appears with a display of the piece selected. Each additional piece selected can be displayed in succession in the selection window 734, so that the order the pieces are selected can be preserved. Upon a selection in the piece list 732, the payout window 738 and the amount window 740 are automatically displayed and updated (the updated information can be calculated using the simulation described above). The amount window 740 is typically originated with a zero dollar amount in the amount bet. When the player enters an amount to bet, then the confirm bet button 742 appears. The box button 736 can appear once two or more pieces have been selected from the selection-window 734. Also, a piece can be de-selected from the piece list 732 or the selection window 734 by click, touching, selecting, etc., the piece the player wishes to de-select. Once a piece is de-selected, then the relevant windows (the selection window 734, the payout window 738, etc.) are updated. Note that if the embodiment illustrated in FIG. 7E is used, then a player does need to previously specify if he wishes to make an exacta bet, quinella, triple, pick 6, etc, because the computer automatically knows the type of bet the player wishes to make by the number of horses selected and whether the box option is selected. Other types of special bets (i.e. multi-line, surrender, etc.) will need to be selected separately.

If any further information is desired about methods for taking and placing a variety of bets, such information is currently available from the New York City Off Track Betting Corporation.

Figure 7F:
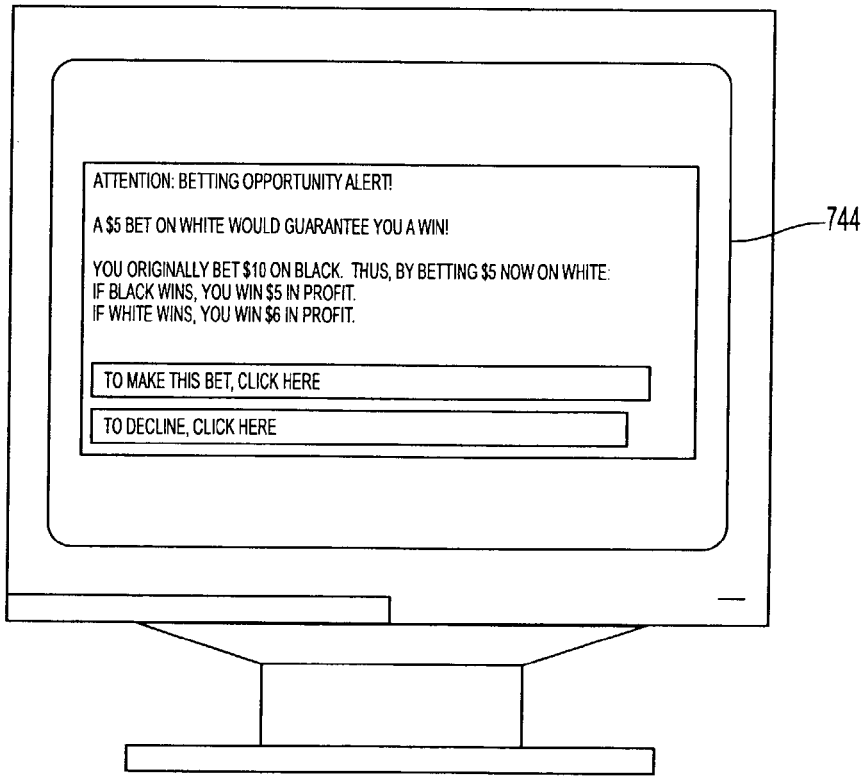
FIG. 7F illustrates an example of a pop-up advertisement window, according to an embodiment of the present invention.

FIG. 7F illustrates an example of a pop-up advertisement window, advertising a particular bet. As discussed above, during course of play, the system may determine that a player may like a certain bet, and advertise the bet. In this case, the advertisement window 744 states, "would you like to bet $5 on white? This will guarantee you a win of $12.24. YES/NO." If the player clicks yes, then the system will proceed to automatically generate an appropriate wagering screen so that the player can easily make that particular bet.

Of course, the above illustrations of a user interface are just one possible method which can be used to take and display wagers using an electronic gaming device in accordance with the wagering method described herein. Many other possible configurations of such an interface can be implemented using standard graphical user interface (GUI) techniques. Any feature described herein or necessary that is not illustrated in these figures can be implemented using such known techniques. Also, FIGS. 7A-7E may or may not all be used for the same system, different screens can be selected and tailored for different systems. Also, typically money is collected at the onset of a playing session by a player depositing cash into a cash receiver or using some form of electronic debit card transaction. The amounts are kept current inside the electronic gaming device, and when the player decides to finish his playing session, accounting is made is the player is paid any funds remaining for the session.

Figure 8:
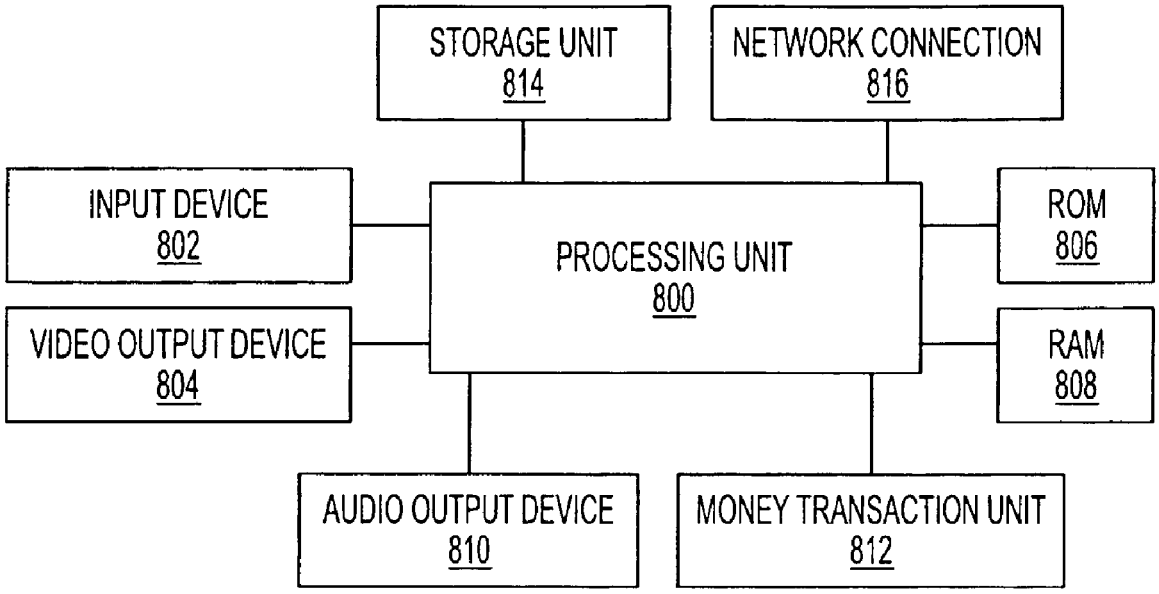
FIG. 8 is a block diagram illustrating digital apparatus used to implement the invention, according to an embodiment of the invention.

FIG. 8 is a block diagram illustrating digital apparatus used to implement the invention, according to an embodiment of the invention.

A processing unit 800 is connected to an input device 802 and a video output device 804. The input device can be any known input device, such as a keyboard, buttons, touch pad LCD, numeric keypad, mouse, etc. The processing unit 800 also can interface with a ROM 806 and a RAM 808. Further the processing unit 800 also can interface with an audio output device 810. In addition, the processing unit is connected to a money transaction unit 812. This money transaction unit 812 is used to collect cash or electronically read and debit/credit an electronic form of payment. The processing unit 800 is also connected to a storage unit 814, which can comprise any nonvolatile storage device such as a hard disk drive, CD-ROM, optical drive, etc. The processing unit 800 is also connected to a network connection 816, which can connect the entire device to the internet, an intranet, LAN, WAN, etc. Thus, the network connection 816 can typically be used to connect this electronic gaming device to a casino system network. Further, any other hardware devices known in the art that are not illustrated or described herein, but which aid in the operation of the electronic gaming device, are incorporated herein.

Figure 9A:
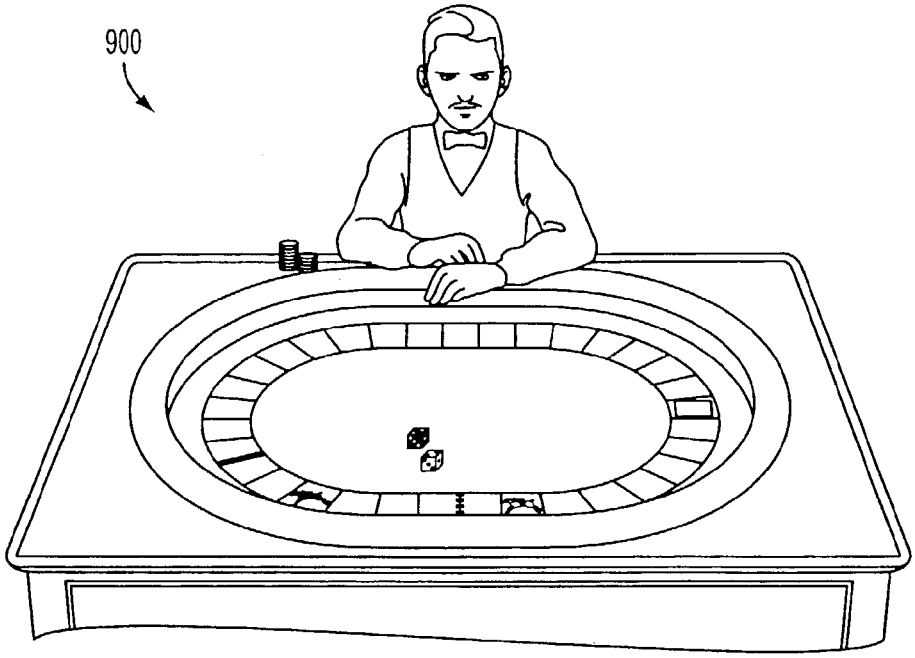
FIGS. 9A, 9B, and 9C are block diagrams illustrating the use of various embodiments of the present invention on a casino floor, according to an embodiment of the present invention.
Figure 9B:
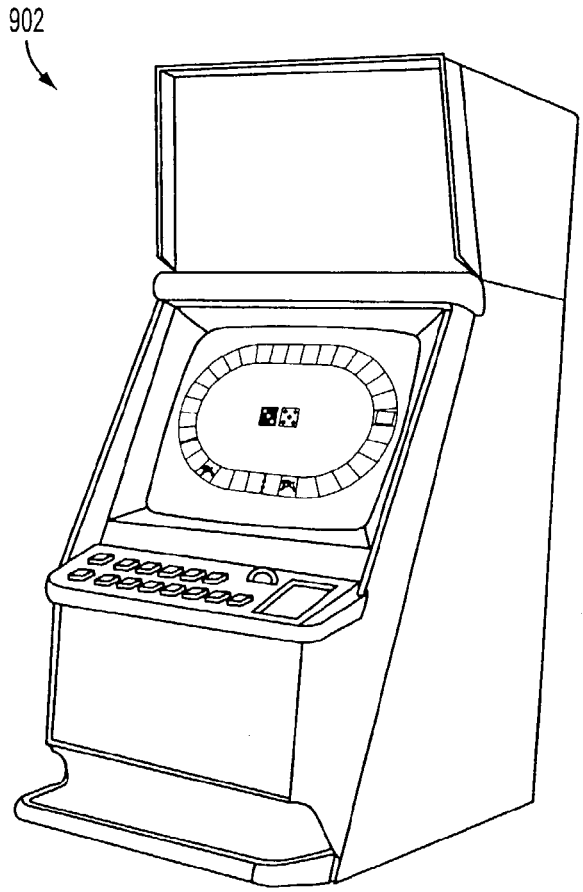
Figure 9C:
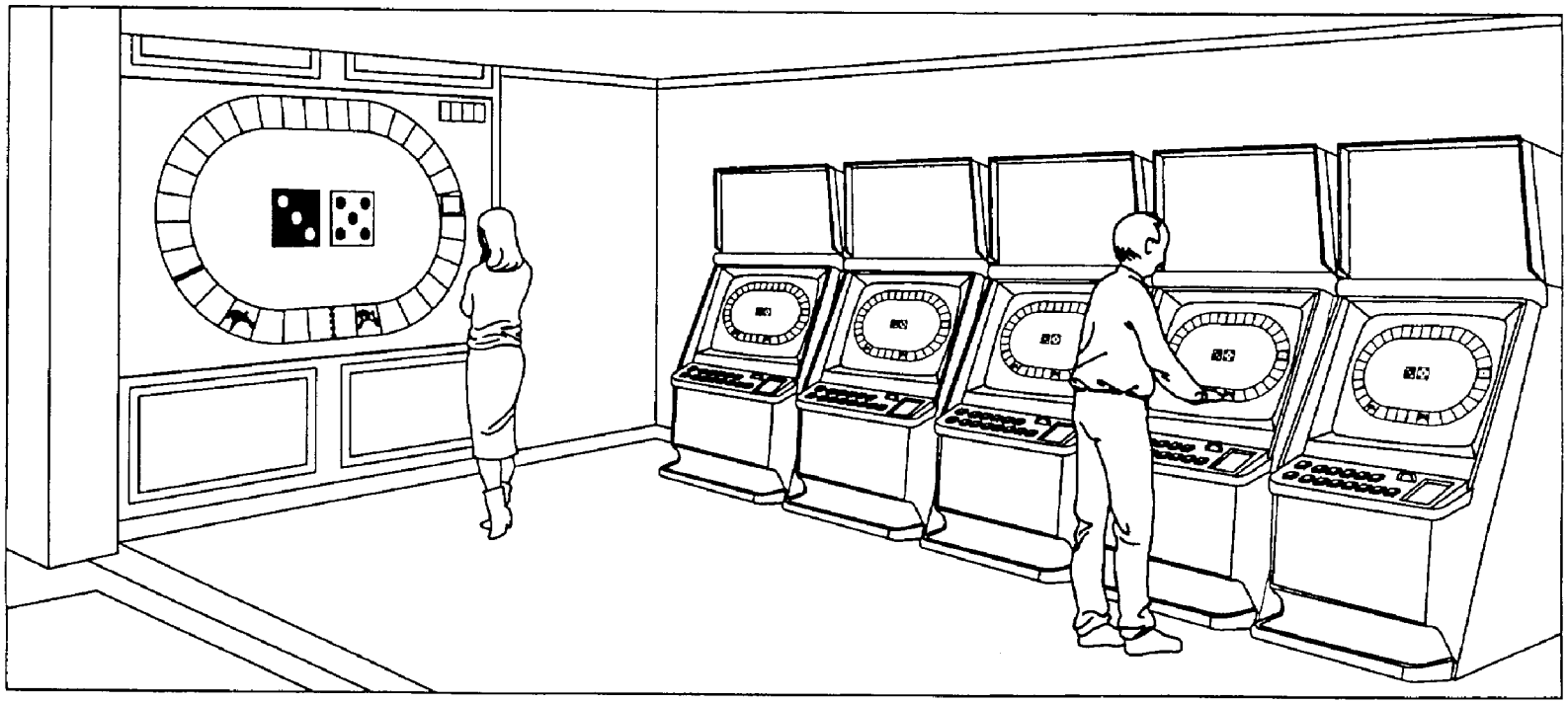

FIGS. 9A, 9B, and 9C are block diagrams illustrating the use of various embodiments of the present invention on a casino floor, according to an embodiment of the present invention.

As illustrated in FIG. 9A, the wagering method described herein can be used as a table game on a casino floor. As illustrated n FIG. 9B, the wagering method described herein can also be used as an electronic gaming device. As illustrated in FIG. 9C, the wagering method can also be implemented in a gaming parlor.

It is noted that all of the variations and embodiments described above can be mixed and matched according to a user's preferences. Further, payout odds can be set using any of the methods described above, or using conventional methods, in accordance with the user's preferences. Moreover, options and embodiments can be implemented at any sequence in the implementation of the invention when the particular option or embodiment can feasibly be implemented. Additionally, information is inputted and outputted not only in accordance with the above descriptions, but also in accordance with what is necessary or desirable to one of ordinary skill in the art in order to implement the present invention.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

APPENDIX A

```
// (c) Michael Shackleford, AKA the Wizard of Odds
#include <iostream.h>
#include <stdlib.h>
#include <string.h>
#include <math.h>
#include <time.h>
#define __WIN32__WINNT 0x0400
#include <windows.h>
#include <wincrypt.h>
struct history
{ int b; int w; };
void simulation(void);
void pre__recursive(void);
void recursive(int whitetot, int blacktot, float *pw, float *pb, float *pt);
int__fastcall RandNum( );
float WhiteTot[28][28],BlackTot[28][28],TieTot[28][28];
void main(void)
{
                                                int ch;
                                                cerr << "1. Simulation\n";
                                                cerr << "2. Recursive\n";
                                                cin >> ch;
                                                if (ch==1) simulation( );
                                                if (ch==2) pre__recursive( );
}
void simulation(void)
{int i,j,count,whitewin,blackwin,tie,whitescore,blackscore,nummin,curtime,
endtime,turn,totturn,totwhitewin[28][28],totblackwin[28][28],tottiewin[28][28];
                                                history pt[28];
                                                cerr << "Enter number of minutes
in simulation: ";
                                                cin >> nummin;
                                                curtime=time(NULL);
                                                endtime=curtime+(60*nummin);
                                                count=0;
                                                whitewin=0;
                                                blackwin=0;
                                                tie=0;
                                                totturn=0;
                                                for (i=0; i<=27; i++)
                                                { for (j=0; j<=27; j++)
                                                    {
                                                        totblackwin[i][j]=0;
                                                        totwhite[i][j]=0;
                                                        tottiewin[i][j]=0;
                                                    }
                                                }
                                                do
                                                {
                                                    count++;
                                                    whitescore=0;
                                                    blackscore=0;
                                                    turn=0;
                                                    do
                                                    {
                                                whitescore+=abs(RandNum( )%6)+
1;
```

APPENDIX A-continued

```
blackscore+=abs(RandNum( )%6)+
1;
        if
((whitescore<28)&&(blackscore<28))
        {
    pt[turn].w=whitescore;
pt[turn].b=blackscore;
            turn++;
            totturn++;
        }
    }
    while
((whitescore<28)&&(blackscore<28));
/*
    if
((whitescore>=28)&&(blackscore<28))
        whitewin++;
    else if
((blackscore>=28)&&(whitescore<28))
        blackwin++;
    else
        tie++; */
    if (whitescore>blackscore)
        whitewin++;
    else if
(blackscore>whitescore)
        blackwin++;
    else
        tie++;
    for (i=0; i<turn; i++)
    {
        if
(whitescore>blackscore)
totwhitewin[pt[i].w][pt[i].b]++;
        else if
(blackscore>whitescore)
totblackwin[pt[i].w][pt[i].b]++;
        else
    tottiewin[pt[i].w][pt[i].b]++;
    }
    if (count%50000==0)
    {
    curtime=time(NULL);
        srand(curtime);
        cerr << "Time
remaining: " << (float)(endtime-curtime)/60 << " minutes\n";
    } }
while (curtime<endtime);
cout << "count =\t" << count <<
"\n";
cout << "black win =\t" <<
blackwin << "\t" << (float)blackwin/(float)count << "\n";
cout << "white win =\t" <<
whitewin << "\t" << (float)whitewin/(float)count << "\n";
cout << "tie =\t" << tie << "\t" <<
(float)tie/(float)count << "\n";
cout << "total mid-game turns =\t"
<< totturn << "\n";
cout << "White wins\n";
for (i=1; i<=27; i++)
{
    cout << i << "\t";
    for (j=1; j<=27; j++)
        cout <<
totwhitewin[i][j] << "\t";
    cout << "\n"; }
cout << "Black wins\n";
for (i=1; i<=27; i++)
{
    cout << i << "\t";
    for (j=1; j<=27; j++)
        cout <<
totblackwin[i][j] << "\t";
    cout << "\n";
}
cout << "Tie wins\n";
for (i=1; i<=27; i++)
{
    cout << i << "\t";
    for (j=1; j<=27; j++)
```

APPENDIX A-continued

```
                                        cout << tottiewin[i][j]
<< "\t";
                                    cout << "\n";
                                }
}
void pre__recursive(void)
{int i,j;
                                float PrWhite,PrBlack,PrTie;
                                for (i=0; i<=27; i++)
                                {
                                    for (j=0; j<=27; j++)
                                    {
                                        WhiteTot[28][28]=0;
                                        BlackTot[28][28]=0;
                                        TieTot[28][28]=0;
                                    }
                                }
                                recursive(0,0,&PrWhite,&PrBlack,
&PrTie);
                                cout << "White wins\n";
                                for (i=1; i<=27; i++)
                                {
                                    cout << i << "\t";
                                    for (j=1; j<=27; j++)
                                        cout <<
WhiteTot[i][j] << "\t";
                                    cout << "\n";
                                }
                                cout << "Black wins\n";
                                for (i=1; i<=27; i++)
                                {
                                    cout << i << "\t";
                                    for (j=1; j<=27; j++)
                                        cout << BlackTot[i][j]
<< "\t";
                                    cout << "\n";
                                }
                                cout << "Tie wins\n";
                                for (i=1; i<=27; i++)
                                {
                                    cout << i << "\t";
                                    for (j=1; j<=27; j++)
                                        cout << TieTot[i][j]
<< "\t";
                                    cout << "\n";
                                }
                                cout << "PrWhite =\t" << PrWhite
<< "\n";
                                cout << "PrBlack =\t" << PrBlack
<< "\n";
                                cout << "PrTie =\t" << PrTie <<
"\n";
                                cout << "White wins\n";
}
void recursive(int whitetot, int blacktot, float *pw, float *pb, float *pt)
{
                                int whiteroll,blackroll;
                                float PrWhite,PrBlack,PrTie;
                                PrWhite=0;
                                PrBlack=0;
                                PrTie=0;
                                for (whiteroll=1; whiteroll<=6;
whiteroll++)
                                {
                                    for (blackroll=1;
blackroll<=6; blackroll++)
                                    {
                                        if
((whitetot+whiteroll>=28)||(blacktot+blackroll>=28))
                                        {
                                            if
(whitetot+whiteroll>blacktot+blackroll)
                                PrWhite+=1.0/36.0;
                                            else if
(blacktot+blackroll>whitetot+whiteroll)
                                PrBlack+=1.0/36.0;
                                            else // tie
                                PrTie+=1.0/36.0;
                                        }
```

APPENDIX A-continued

```
                                                    else
                                                    {
                                                        if
(WhiteTot[whitetot+whiteroll][blacktot+blackroll]>0)    {
                                                PrWhite+=WhiteTot[whitetot+whit
eroll][blacktot+blackroll]/36;
                                                PrBlack+=BlackTot[whitetot+white
roll][blacktot+blackroll]/36;
                                                PrTie+=TieTot[whitetot+whiteroll]
[blacktot+blackroll]/36;
                                                    } else {
                                                recursive(whitetot+whiteroll,blackt
ot+blackroll,pw,pb,pt);
                                                PrWhite+=*pw/36.0;
                                                PrBlack+=*pb/36.0;
                                                PrTie+=*pt/36.0;
                                                    } } } }
                                                WhiteTot[whitetot][blacktot]=PrW
hite;
                                                BlackTot[whitetot][blacktot]=PrBla
ck;
                                                TieTot[whitetot][blacktot]=PrTie;
                                                *pw=PrWhite;
                                                *pb=PrBlack;
                                                *pt=PrTie;
//                                              cerr << whitetot << "\t" << blacktot
<< "\t" << PrWhite << "\t" << PrBlack << "\t" << PrTie << "\n";
                                                return;
}
int__fastcall RandNum( )
{                                           static HCRYPTPROV Provider = NULL;
                                            int RetValue;
                                            if (!Provider)
                                                {
                                                if
(!CryptAcquireContext(&Provider, NULL, NULL, PROV__RSA__FULL, 0))
                                                if
(!CryptAcquireContext(&Provider, NULL, NULL, PROV__RSA__FULL,
                                                CRYPT__NEWKEYSET))
                                                    return(0);
                                                RandNum( ); // Throw out first
number. Possibly non-random.
                                                }
                                                RetValue = 0;
                                                if (!CryptGenRandom(Provider,
sizeof(int), (unsigned char *) &RetValue))
                                                RetValue = 0;
                                                return(RetValue);
}
```

What is claimed is:

1. A method of wagering, the method comprising:

receiving from a player a wager on a selected piece from a plurality of pieces;

displaying, advancing and completing a game of chance progression of the plurality of pieces;

if the selected piece completes the progression ahead of non-selected pieces, paying an award based on the wager to a player; and if the selected piece completes the progression behind one of the non-selected pieces, taking the wager from the player, wherein the completing comprises continuing to receive additional wager(s) from the player after at least one piece has moved but before the game is completed, the wagers having respective payouts based on probabilities of respective pieces completing the progression first based on respective positions of the pieces, wherein the advancing advances the plurality of pieces simultaneously, wherein each piece of the plurality of pieces is assigned its own respective random number generator and is advanced according to a random outcome of its respective random number generator.

2. A method of wagering as recited in claim 1, wherein the completing a progression comprises:

rolling a respective die for each piece; and moving each piece based on the rolling of the respective die.

3. A method of wagering as recited in claim 1, wherein the game of chance progression is progressed by using an advancing mechanism which generated advancing numbers with each of the numbers having an equal chance of being generated.

4. A method of wagering as recited in claim 1, wherein the progression comprises moving horses around a racetrack.

5. A method of wagering as recited in claim 1, wherein the progression comprises moving climbers up a building.

6. A method of wagering as recited in claim 1, wherein the method is implemented as a table game.

7. A method of wagering as recited in claim 1, wherein the method is implemented on an electronic gaming device.

8. A method as recited in claim 1, wherein the method is implemented in a gaming parlor.

9. A method as recited in claim 1, further comprising offering a wager that a piece chosen by the player will tie with another piece.

10. A method of wagering, the method comprising:

receiving from a player a wager on a selected piece from a plurality of pieces;

displaying and completing a game of chance progression of the plurality of pieces;

if the selected piece completes the progression ahead of non-selected pieces, paying an award based on the wager to a player;

if the selected piece completes the progression behind one of the non-selected pieces, taking the wager from the player; and if the selected piece ties with one of the non-selected pieces to complete the progression first, taking a fraction of the wager from the player, the fraction being smaller than one.

11. A method of wagering as recited in claim 10, wherein the fraction is one half.

12. A wagering apparatus, the apparatus comprising:

a wagering device receiving from a player a wager on a selected piece from a plurality of pieces;

a display displaying and completing a game of chance progression of the plurality of pieces;

if the selected piece completes the progression ahead of non-selected pieces, paying an award based on the wager to a player using the wagering device;

if the selected piece completes the progression behind one of the non-selected pieces, taking the wager from the player using the wagering device; and if the selected piece ties with one of the non-selected pieces to complete the progression first, taking one half of the wager from the player.

13. A wagering apparatus, the apparatus comprising:

a wagering device receiving from a player a wager on a selected piece from a plurality of pieces;

a display displaying and completing a game of chance progression of the plurality of pieces;

if the selected piece completes the progression ahead of non-selected pieces, paying an award based on the wager to a player using the wagering device;

if the selected piece completes the progression behind one of the non-selected pieces, taking the wager from the player using the wagering device; and if the selected piece ties with one of the non-selected pieces to complete the progression first, taking compensation from the player using the wagering device, wherein when the selected piece ties, the taking compensation from the player comprises taking a fraction of the wager, the fraction being smaller than one.

14. An apparatus as recited in claim 13, wherein the completing a progression comprises:

rolling a respective die for each piece; and moving each piece based on the rolling of the respective die.

15. An apparatus as recited in claim 13, wherein the game of chance progression is progressed by using an advancing mechanism which generates advancing numbers with each of the numbers having an equal chance of being generated.

16. An apparatus as recited in claim 13, wherein the progression comprises moving horses around a racetrack.

17. An apparatus as recited in claim 13, wherein the progression comprises moving climbers up a building.

18. An apparatus as recited in claim 13, wherein the wagering device is implemented as a table game.

19. An apparatus as recited in claim 13, wherein the wagering device is implemented as an electronic gaming device.

20. An apparatus as recited in claim 13, wherein the wagering device is implemented in a gaming parlor.

21. An apparatus as recited in claim 13, wherein the wagering device offers a wager that a piece chosen by the player will tie with another piece.

22. A method of wagering, the method comprising:

providing at least two pieces and at least two random number generators, each one of the random number generators corresponds to one of the at least two pieces, all of the at least two pieces has a unique corresponding random number generator, there being an equal number of random number generators and pieces;

displaying first payouts for each of the at least two pieces on whether each respective piece will reach a finish line first;

receiving a first wager from a player a wager on whether a first selected piece selected from the at least two pieces will reach the finish line first using the first payouts;

activating the at least two random number generators simultaneously to generate a random outcome for the at least two random number generators;

advancing the at least two pieces on a playing field simultaneously according to the random outcome, wherein each piece is advanced according to an outcome of each piece's corresponding random number generator;

displaying second payouts for each of the at least two pieces on whether each respective piece will reach the finish line first;

receiving a second wager from the player on whether a second selected piece selected from the at least two pieces will reach the finish line first using the second payouts; and continuing the activating and advancing until at least one winning piece out of the at least two pieces reaches the finish line, wherein the second payouts are based on odds that each piece will finish first based on simultaneous advancing.

23. The method as recited in claim 22, wherein the second payouts are determined using a real time random simulation.

* * * * *